United States Patent [19]

Kappes et al.

[11] 4,006,658

[45] Feb. 8, 1977

[54] ORGAN CAPTURE ACTION

[75] Inventors: Joseph L. Kappes, Springfield Township, Ohio; Walter Munch, Jr., Fort Thomas, Ky.; Dale M. Uetrecht, Colerain Township, Ohio

[73] Assignee: D. H. Baldwin Company, Cincinnati, Ohio

[22] Filed: Jan. 26, 1976

[21] Appl. No.: 652,515

Related U.S. Application Data

[63] Continuation of Ser. No. 462,101, April 18, 1974, abandoned.

[52] U.S. Cl. ..... 84/345; 84/370

[51] Int. Cl.[2] ..... G10B 3/10; G10H 1/00

[58] Field of Search ..... 84/1.01, 337–345, 84/369, 370

[56] References Cited

UNITED STATES PATENTS

| | | | |
|---|---|---|---|
| 2,954,716 | 10/1960 | Raymond | 84/337 |
| 3,103,847 | 9/1963 | Raymond | 84/345 |
| 3,213,179 | 10/1965 | Clauson | 84/345 X |
| 3,422,718 | 1/1969 | Noehren | 84/345 |
| 3,449,995 | 6/1969 | Sepp, Jr. | 84/345 |
| 3,498,168 | 3/1970 | Cunningham | 84/345 |
| 3,548,064 | 12/1970 | Oncley | 84/345 X |
| 3,659,448 | 5/1972 | Deutsch | 84/345 |
| 3,686,994 | 8/1972 | Badessa | 84/345 |
| 3,699,839 | 10/1972 | Denigan et al. | 84/345 |
| 3,700,784 | 10/1972 | Molnar | 84/345 |
| 3,733,593 | 5/1973 | Molnar | 84/1.01 X |

*Primary Examiner*—Stanley J. Witkowski
*Attorney, Agent, or Firm*—Kirkland & Ellis

[57] ABSTRACT

The present system is a capture action system for electronically recording stop tab configurations in an electric organ, and for recalling the stop tab configurations at will, by depressing of a single control piston for each desired configuration of stop tabs. The system includes provision for setting and recalling combinations of stop tabs associated with a single division of the organ, for example, the swell manual, but not affecting tabs in other divisions, and also includes provision for recording and recalling combinations of all tabs on the organ (general stop) without regard to division. The system further includes a divisional or general cancel function, for operated tab switches, resetting these to inoperative position, and reversible stop functions in which a control piston when actuated reverses the position of its associated stop tab, the reversible stops retaining their abilities to function within the divisional and general combinations. The system is capable of accommodating a maximum of 128 stop tabs, divided into five divisions of the organ, each of which may contain any desired fraction of the total number of stops of the organ, provided that the divisional stops are each allocated to only one division. In operation, tabs which are desired to be operable in combinations are actuated and a set piston and a recall piston are then operated, which stores the locations of the actuated pistons in a memory consisting of 23 channels. One of these channels is required for each general piston and one channel is required for one piston in each division. General and divisional cancel functions require no memory. The reversible stop function uses a temporary memory which is not the same as the memory used for combination stop. The present system is capable of cycling in .27 seconds and within .067 seconds of the start of this cycle all stop tabs have initiated motion.

When the memory is read out tab actuating coils are multiplexed at a 60 Hz. rate, deriving power directly from a 60 Hz. power line transformer. The multiplexing reduces active drive elements and cabling to a fraction of the normal requirement, while achieving rapid actuation of the tabs. The system is normally in a stand-by condition in which the memory continues to recirculate at a very low rate and certain stand-by elements of the system are energized from batteries. Upon operating the latch for either read out or storage, a mode sequence control applies power from a power supply to all the elements of the system, accelerates the clock rate to a normal rate of 400 KHz., and sequences through the 128 tab positions of the system for one cycle, in the process either recording tab information or reading out tab information and setting the tabs, according as a set piston is or is not operated, the piston latch positions not being multiplexed but only the tab positions being multiplexed and continuous repetitive read-in and read-out not being required, but only a single read-out cycle or read-in cycle.

10 Claims, 25 Drawing Figures

LINE COUNTER LOGIC TIMING

ON COIL
OFF COIL
ONDm
OFDm
D802
D804
D803
D801
CPn
TAB COIL TYPICAL of 128

Vss
OFC
ONC
Dm+1
T9
T8
SCR 1
SCR 2
RB
LOW CURRENT DRIVER
TYPICAL of 16

HCDn
HV1 for "n" ODD
HV2 for "n" EVEN
T7
C7
C8
D701
R701
R702
T701
+16
Yn
HIGH CURRENT DRIVER
TYPICAL of 8 (EXCLUDING TRANSFORMER T)

FIG.10 HIGH CURRENT DRIVERS LOGIC TIMING
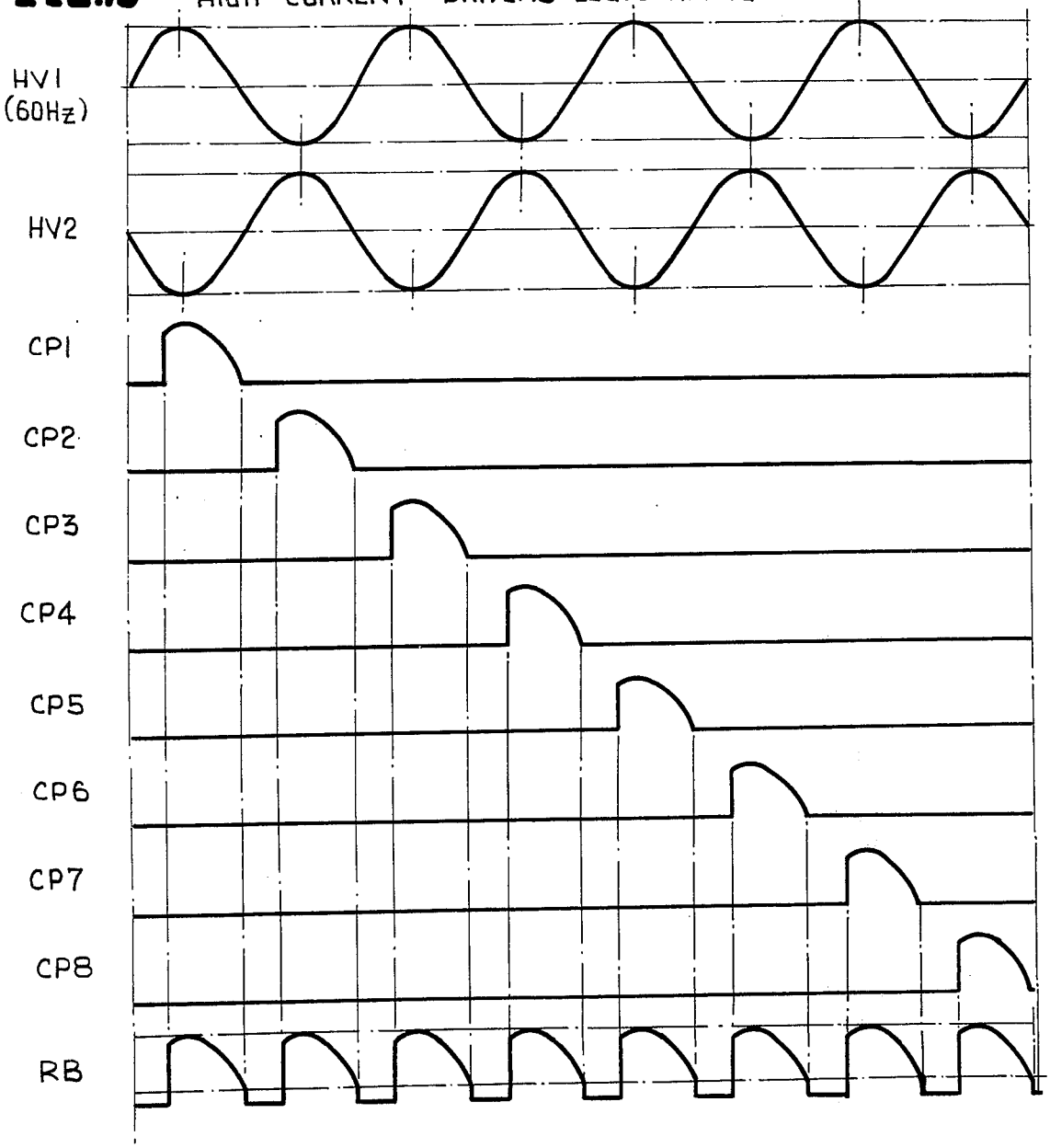
FIG.11 LOW CURRENT DRIVERS LOGIC TIMING
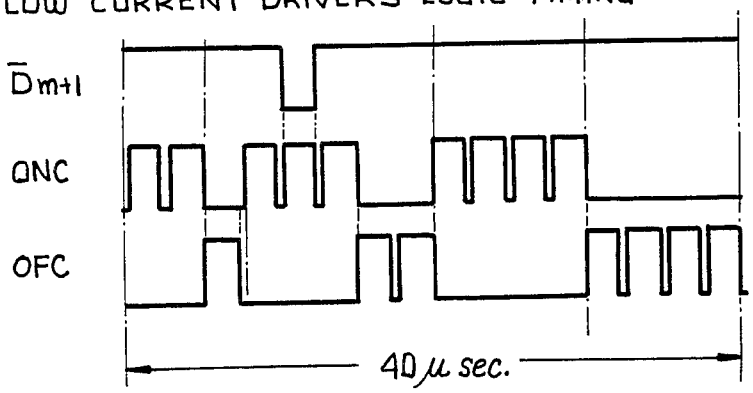

SYSTEM CLOCK LOGIC TIMING

CLOCK PERIOD IS 2.5μ sec.

7 BIT 400KHz, COUNTER and DECODER

COUNTER LOGIC TIMING

PROGRAMMABLE TIME SLOT DECODER and PISTON GATE

PROGRAM / READOUT CONTROL

SWITCH ENCODER

MEMORY LOGIC TIMING

POWER SUPPLY TURN-ON/OFF TIMING

MEMORY LOGIC TIMING

ORGAN CAPTURE ACTION

There is a continuation, of application Ser. No. 462,101 filed Apr. 18, 1974, and now abandoned.

BACKGROUND OF THE INVENTION

The invention relates to a capture combination system for an electronic organ, and affords manual control of an internal memory for establishing desired stop combinations and for storing these combinations until such time as they are called for. Upon one read-out of the memory the stop tabs which had been stored for sequentially operated on a time division multiplex basis.

Combination systems for organs have been heretofore known, including those which utilize electronic memories and time division multiplex techniques. Typically in such systems a number of pistons and a number of stop tabs are associated with each division or keyboard of the organ and certain of the pistons (generals) are capable of reading in and recalling all the stop tabs of the organ. Pistons are generally grouped in categories according to their control capabilities. Divisional pistons, for example, are associated with a corresponding division and provide for control of only those stop tabs which are associated with that division. Divisional stop tabs are generally grouped in adjacent positions, there being one group for each division. In addition general pistons are provided for control of a combination of all the stops in the organ simultaneously, regardless of the relationship of those groups or those stops to specific divisions of the organ. It is required that the general pistons in no way restrict selection of the divisional pistons or divisional stops and vice versa.

Combination stops of the multiplexing type require a memory into which stop tab information may be stored and from which the information may be read when required. In the present case, the memory is totally internal of the organ and takes the form of a plurality of electronic shift registers. A capture and combination system permits the organist to set information into the memory by means of simply operated controls, information being constituted of those groups of stops for a division or for the entire organ which the organist has found by experience to provide pleasing combinations of tones. Absent a combination stop action the organist would be required to select the set of tabs by hand, and this is a time consuming operation, lending itself to inaccuracy because of the speed with which the selection operation must be carried out and also because great reliance must be placed upon the memory of the organist. Prior art systems have provided for multiplexing piston positions, since there may be approximately 25 such pistons in a church organ, and also provide for multiplexing the tab position information. In one system known to applicant, all the information available i.e., piston positions and stop tab positions are continuously recycled during read-out of memory. In the present invention, pistons are not multiplexed and the read-out operation is carried out only once, in the process reading into memory or out of memory required positions of all 128 tabs which are present.

SUMMARY OF THE INVENTION

The present invention employs a shift register memory having 12 256 bit shift registers each representing two parallel 128 bit shift registers, multiplexed to obtain 256 bits. 128 bits equals the number of stop tabs which are to be controlled in the system, and the settings of the stop tabs constitute data. By writing a sequence of data into memories only in one phase of the clock, $\phi$ 1, the data is entered into the odd bit locations of the shift registers. This data can be separated at the output. Therefore, a 256 bit shift register can be addressed as if it were a 128 bit shift register. The memory then consists of 12 channels, each having two memory cells, or a total of 24 memory cells. One cell is used to store a reference bit from which the system can be synchronized. The remaining 23 cells are available for data storage.

The system operates from 60 Hz. line frequency, particularly employing 60 cycle line current in read-out of the stop tabs, an operation which requires energization of tab actuating coils. According to the system the coils are operated from the 60 cycle line in sequenced groups via a high current driver and the tabs of each group are sequenced by means of a common set of low current drivers which may operate either a set coil or a reset coil. The high current drivers operate from 60 cycle line current which is also used to provide a clock for a three bit counter. The output of the clock is decoded into an eight phase scanning sequence $Y_1$–$Y_8$ which is then used as a basic component for multiplexing. A high frequency clock operating at 400 KHz. is also provided. This clock operates a 7 bit counter, the first 4 bits of which are decoded into sixteen sequential pulses, identified as D1 – D16, and the last three bits of which are decoded into eight sequential pulses, identified as X1 – X8. Each pulse, X1, X2 . . . , includes pulses D1 through D16, so that the combination of X and D defines 128 sequential time slots.

The 128 sequential time slots are allocated to the stop tab groupings by divisions and as generals. The 7 bit counter is decoded into five sequential divisional pulses, by means of a decoder which is programmable internally of the organ by means of jumper wires. Each of these pulses defines a division. The five sequential pulses do not necessarily include all 128 time slots. Therefore, the remaining time slots which are not included in the five divisions are reserved for generals only. Thus there are five sequential time slots, one for each of five divisions and the sixth for generals only.

The output of the 60 cycle counter represents eight bits identified as Y1 – Y8. The Y1–Y8 and the X1–X8 pulses are combined in an and/or invert gate, yielding $\overline{XY} = (\overline{X1Y1 + X2Y2 + X3Y3 + X4Y4 + X5Y5 + X6Y6 + X7Y7 + X8Y8})$. By using $\overline{XY}$ as a strobe for different logic functions the non-synchronous 60 cycle and 400 kilocycle pulses become compatible.

The tab switches are scanned by time sequence Y1 through Y8. During Y1 16 tabs are scanned by a sixteen line to 1 line multiplexer in time sequence corresponding to D1 through D16. The multiplexer is strobed with $\overline{XY}$. Therefore, during Y1 (a relatively long period pulse) 16 tabs are scanned in X1. Similarly, 16 more tabs are scanned in X2 during Y2, X3 during Y3, etc. The output data file therefore scans all 128 bit positions X1, D1 through X8, D16 in time sequence.

During normal standby with the system on, the shift register is the only logic operable other than a mode control, and a clock operating at sub-normal rate. The shift register is being recycled continuously at that rate, and the mode control is ready to accept a signal to operate in response to actuation of a piston, with or without concurrent operation of a set piston. The clock and the shift register are powered by a battery during standby operation, and remain active when the system is turned off. Upon operation of a control piston and set piston, in order to read information into the registers, or a control piston alone to read information out of the registers, rectifier power supplies are turned on and all the components of the system become operative.

When a control piston is operated, a pair of latches is operated, each latch representing a memory in the sense that it stays on until a sequence of operations is completed. The pair of latches consists of a time slot control latch and a memory control latch. A signal $\overline{SS}$ deriving from the latch triggers the mode control into its operate cycle. First, two power supplies are turned on in the appropriate sequence to avoid transient misfiling of data into memory. Second, the counter sync control is enabled, producing a sync pulse from a reference memory cell, which is now gated to the 400 KHz. counter and decoder to synchronize the scanning of the stop tabs to the data previously stored in memory and which had been recirculating at a slow rate. Thirdly, if a set piston is held depressed, data is written into the memory while if the set piston is not held depressed, data is read out of the memory, in one read cycle encompassing 128 tabs. Fourth, the two power supplies are turned off in appropriate sequence to avoid transient misfiling of data into memory, or transient misreading of data from the memory.

Assume that one memory control latch and one time slot control latch had been latched in by the depression of one control piston. If the latches correspond to memory channel 3 and general time slot group LG2, for example, the data file will be written into the 128 bit locations of memory channel 3, corresponding to phase 2 of the clock, each memory channel having a total of 256 bits, 128 bits corresponding to each clock phase. If the latches correspond to memory channel 2, and division time slot group LD1, the data will be written into the LD1 bit locations of memory channel 2, corresponding to phase 1 of the clock. LD1 is the number of time slots assigned to division 1 by the programmable division time slot decoder. Other control pistons can be assigned to memory channel 2 corresponding to phase 1 of the clock in divisions LD2, LD3, LD4 and LD5 because they are non-overlapping in time.

A memory channel used for divisions, corresponding to phase 1 of the clock, cannot be used for a general LG1 in phase 1. It can and generally will be used for a general LG2 in phase 2. The remaining latches are not used for permanent storage control and are therefore not discussed at this point. Phase 2 of channel 1 is reserved for the counter sync pulse, and for that reason no piston can be used to latch in channel 1 and LG2. To summarize, the 60 line sets up $Y_1 - Y_8$. A 400 Hz. clock sets up 16 pulses, $D_1 - D_{16}$, and 8 pulses $X_1 - X_8$ = 3 bits from a 7 bit counter, $X_1 = D_1 - D_{16}$, $X_2 = D_1 - D_{16}$, etc. $16 \times 8 = 128$ = total number of time slots available.

The Y and X pulses are combined to form $\overline{XY} = \overline{X1Y1} + \overline{X2Y2} \ldots \overline{X8Y8}$, which act as strobe pulses for logic functions and render compatible the 60 and 400 Hz. pulses.

During Y1, 16 tabs are scanned by $D_1 - D_{16}$, strobed by $\overline{XY}$. Therefore, 16 tabs are scanned in $X_1$. During $Y_2$ 16 more tabs are scanned in $X_2$ etc. Therefore, the scan goes — during $Y_1$ 16 tabs are scanned in $X_1$, during $Y_2$ 16 tabs are scanned in $X_2$, etc., until 128 tabs are scanned.

DETAILED DESCRIPTION OF THE DRAWINGS

Figure 2A:
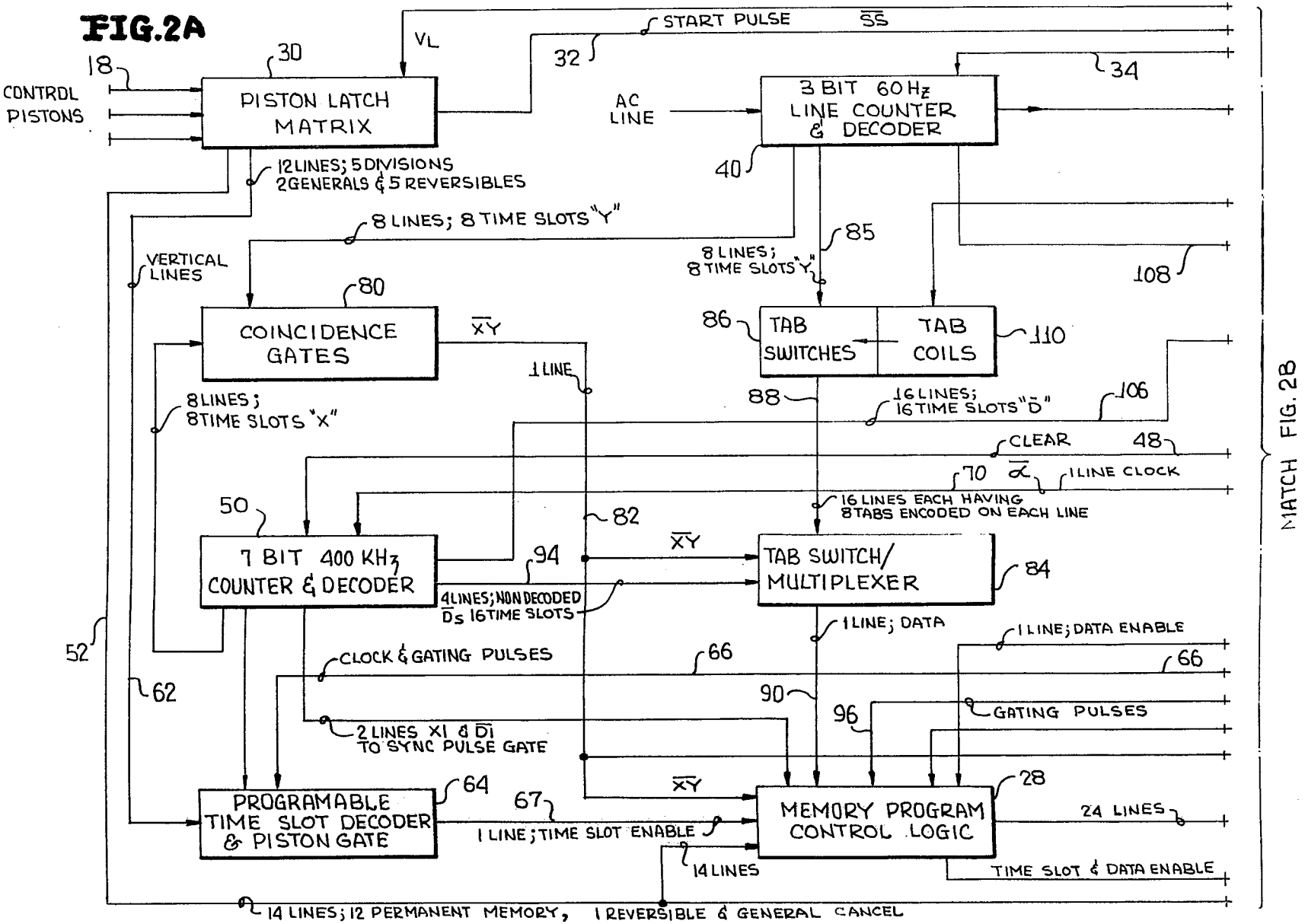
FIGS. 2A and 2B is a block diagram of the complete system of FIG. 1, keyed to the logic and circuit diagrams of the system.
Figure 2B:
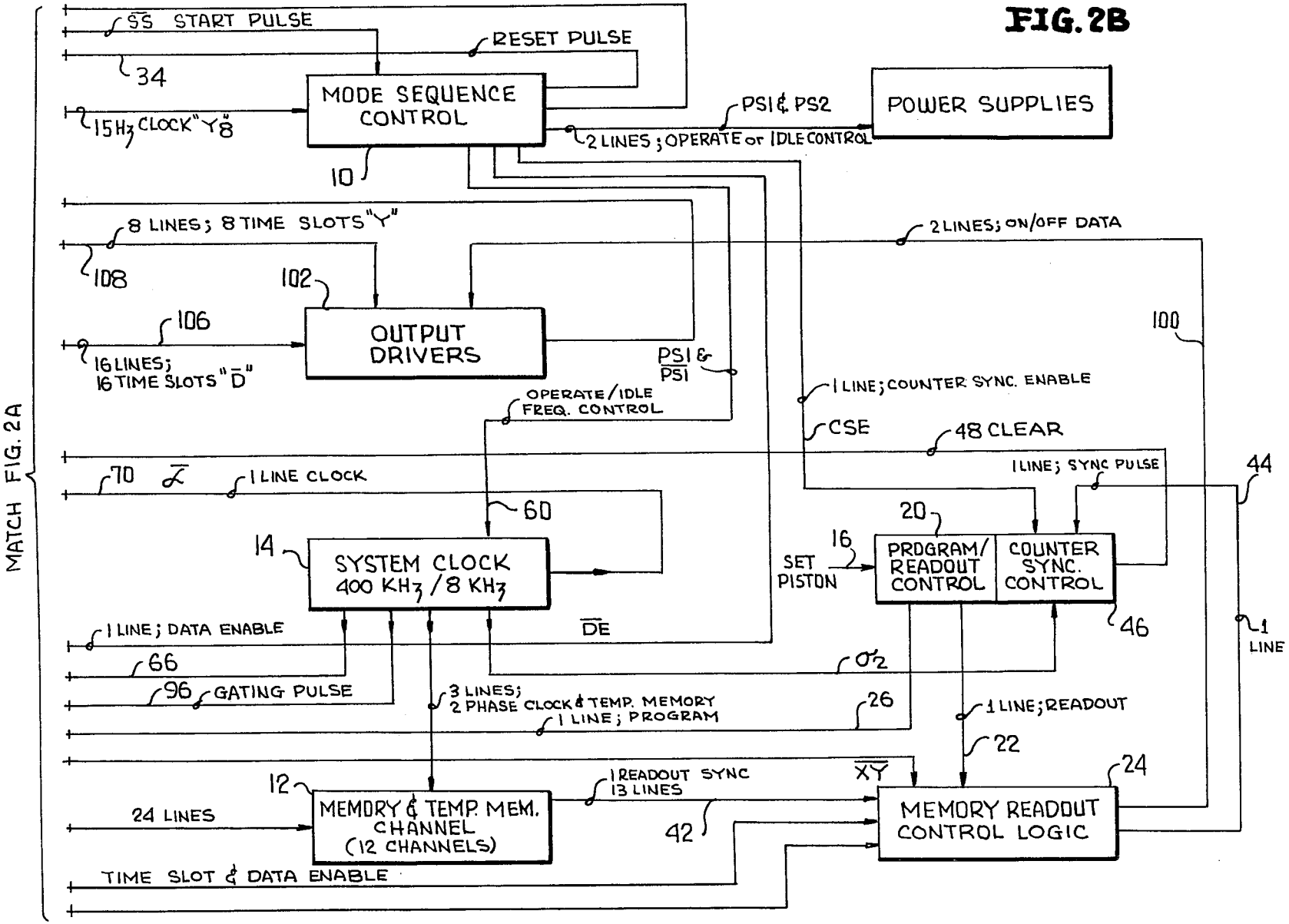
Figure 3:
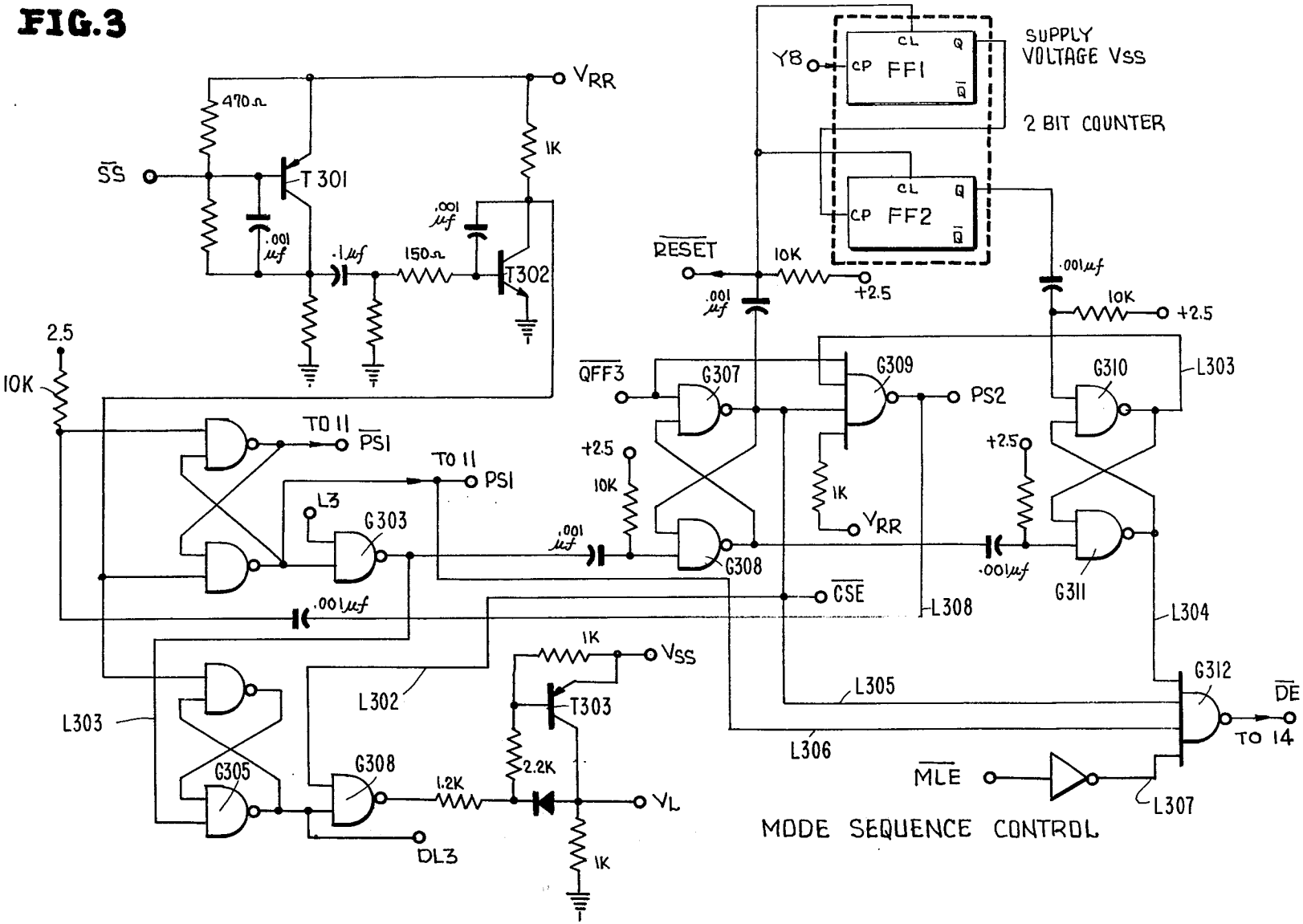
FIG. 3 is a logic diagram of the mode sequence control of the system of FIGS. 2A and 2B.
Figure 4:
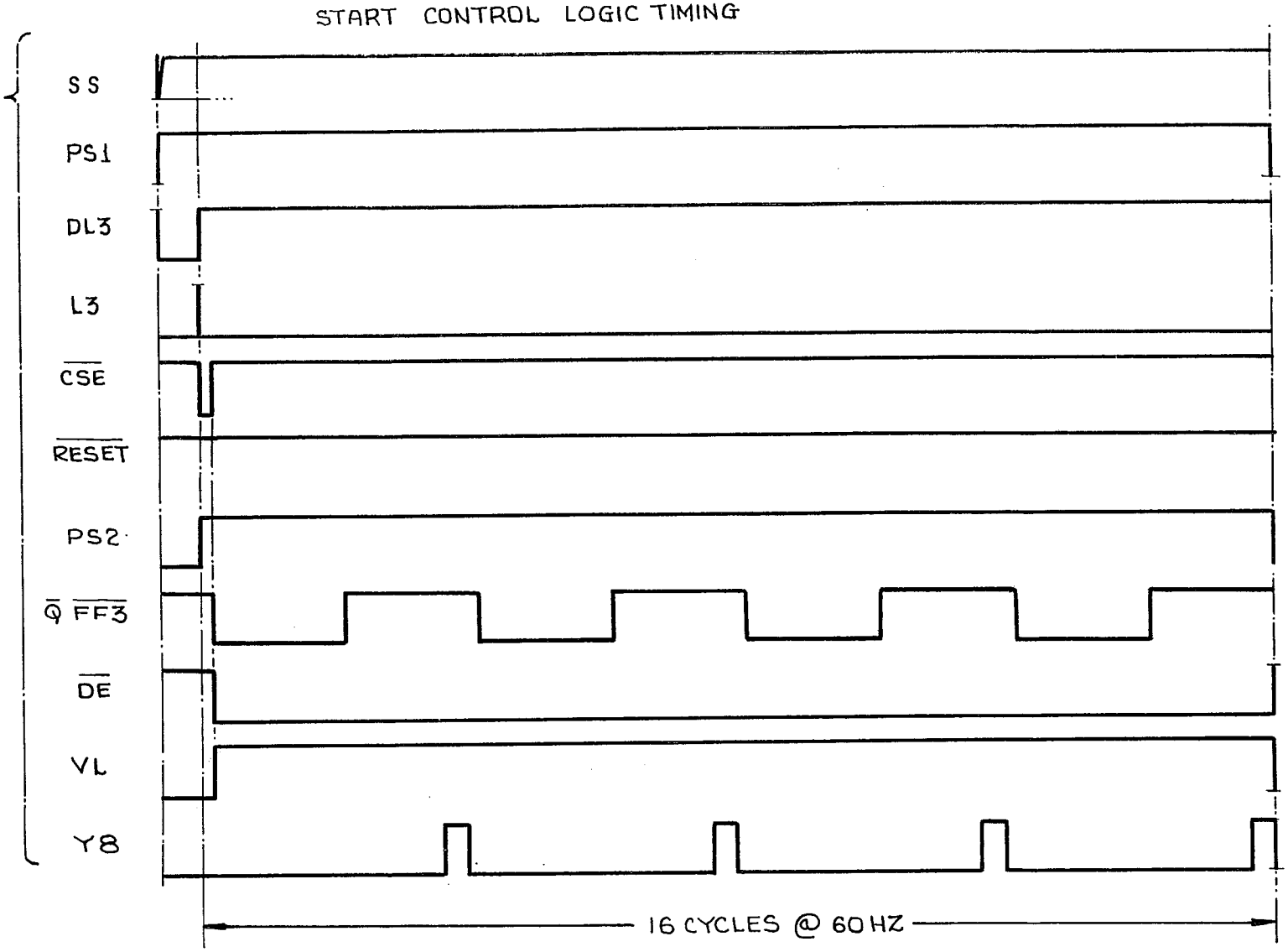
Figure 5:
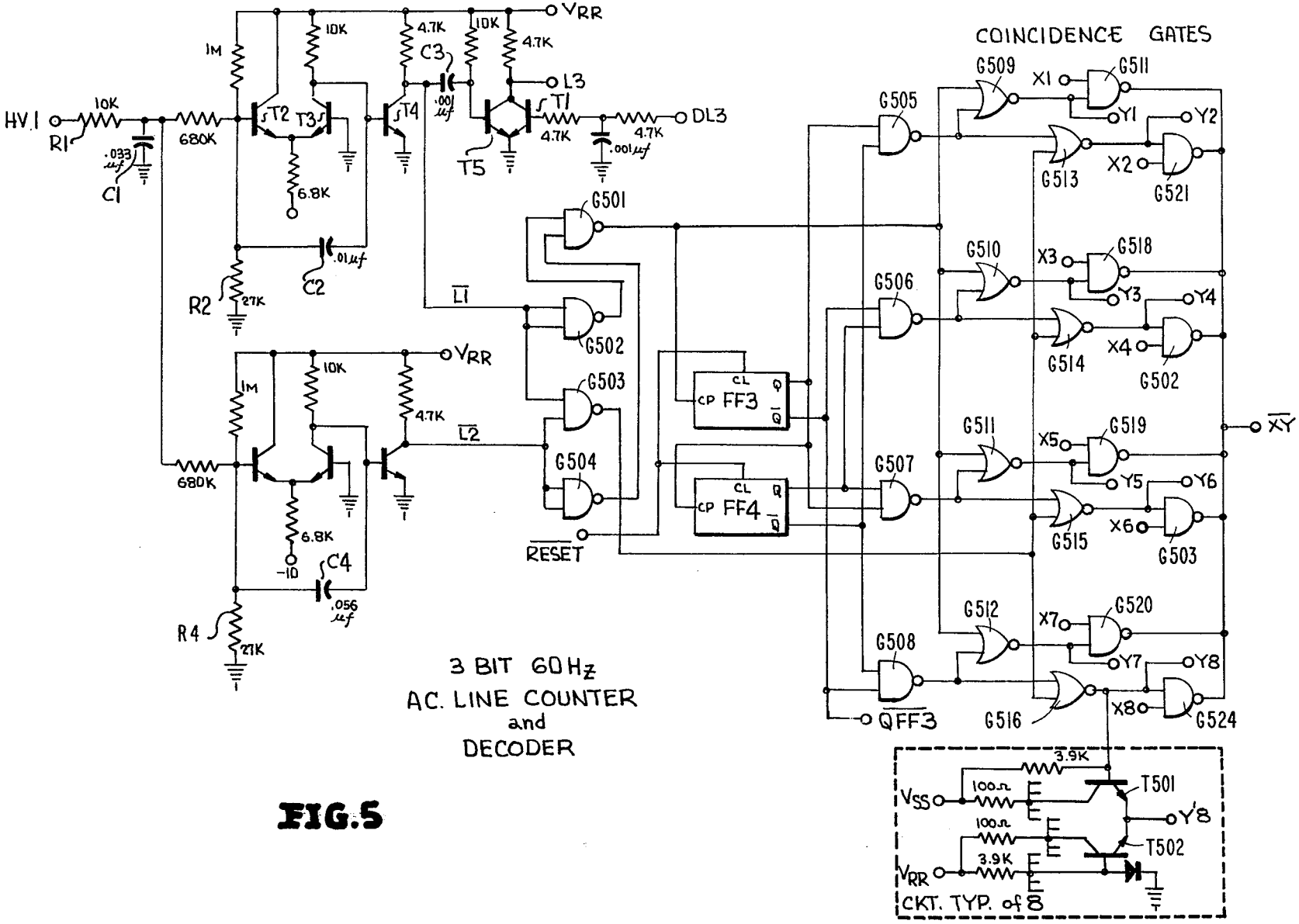
Figure 6:
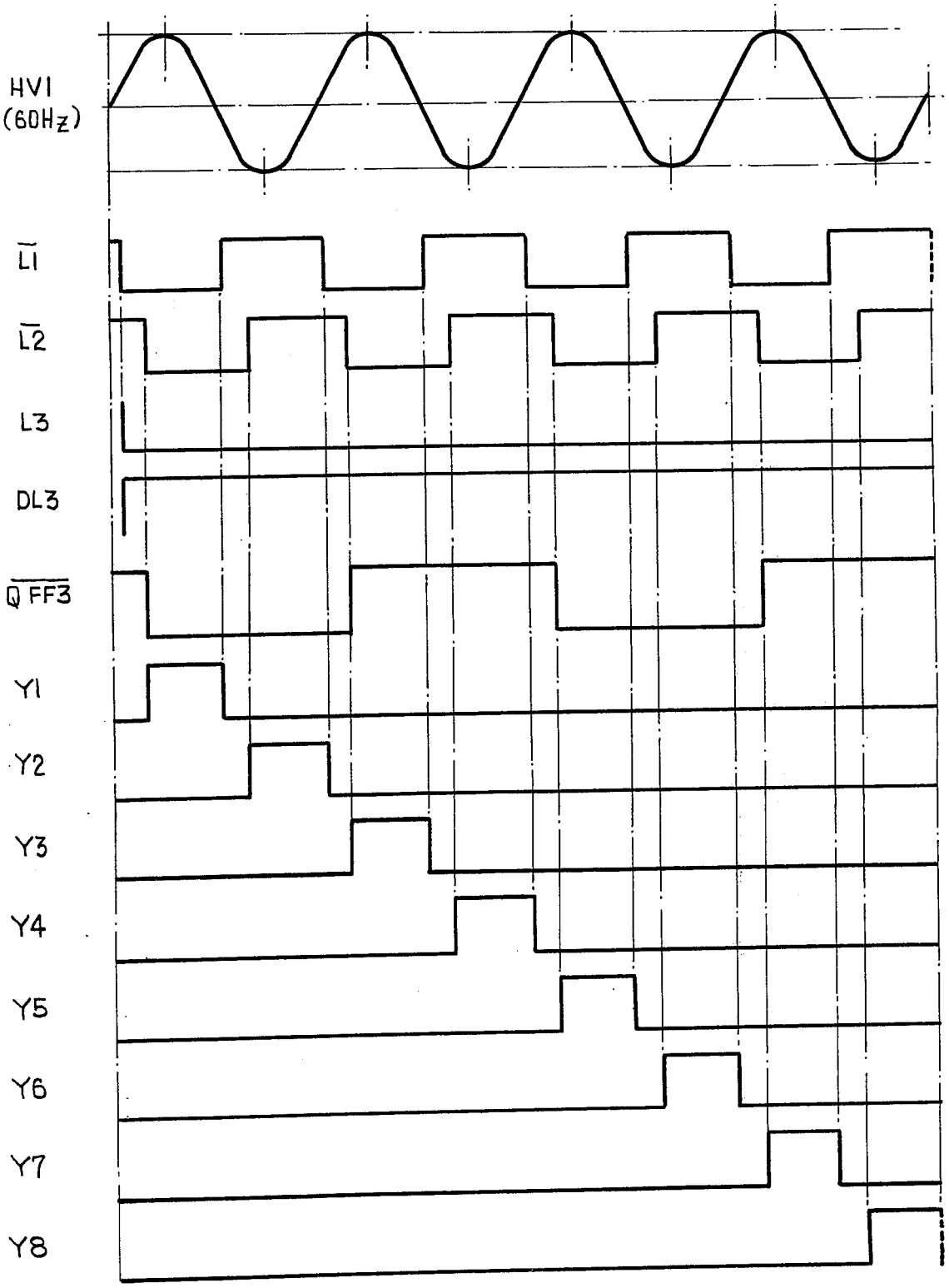
Figures 7, 8, 9:
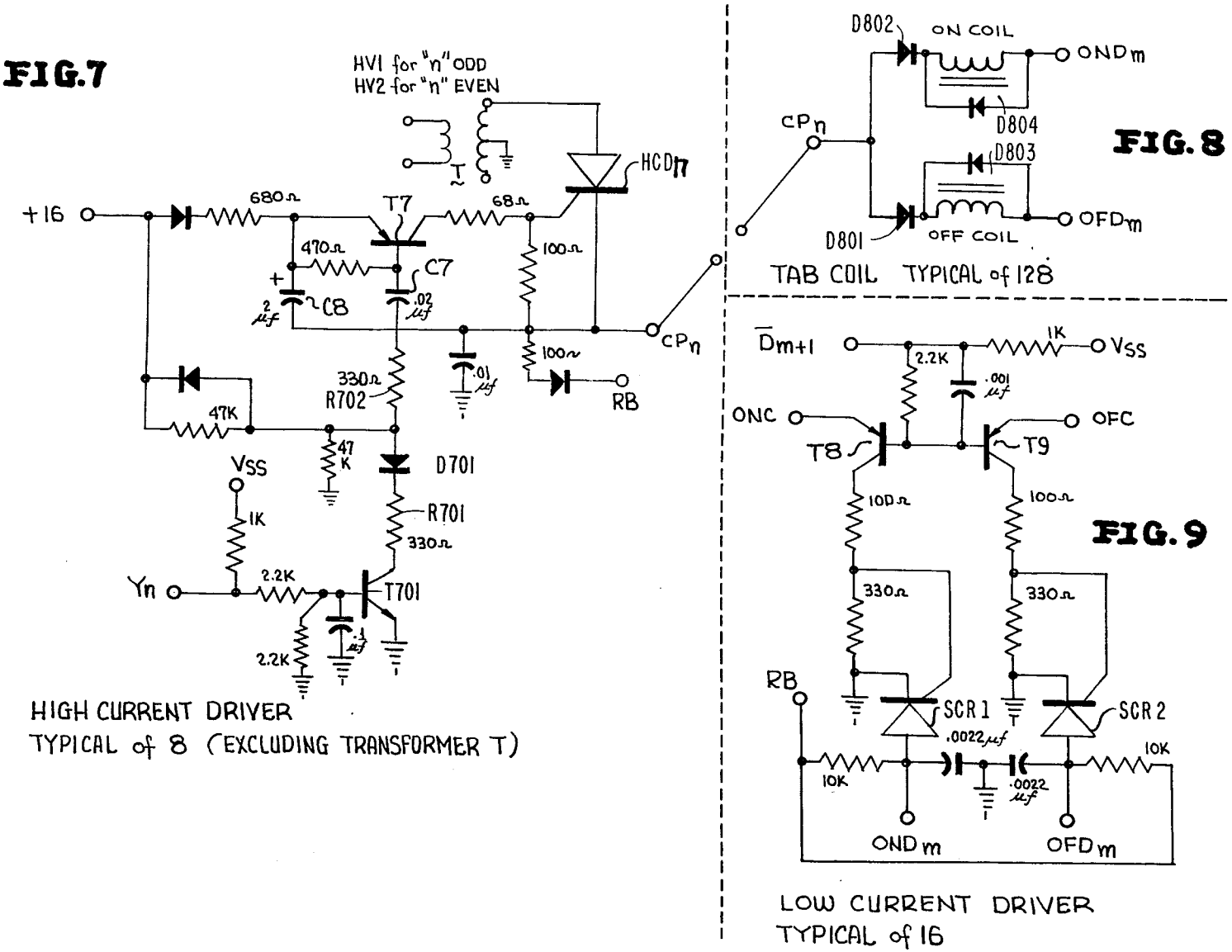
Figure 12:
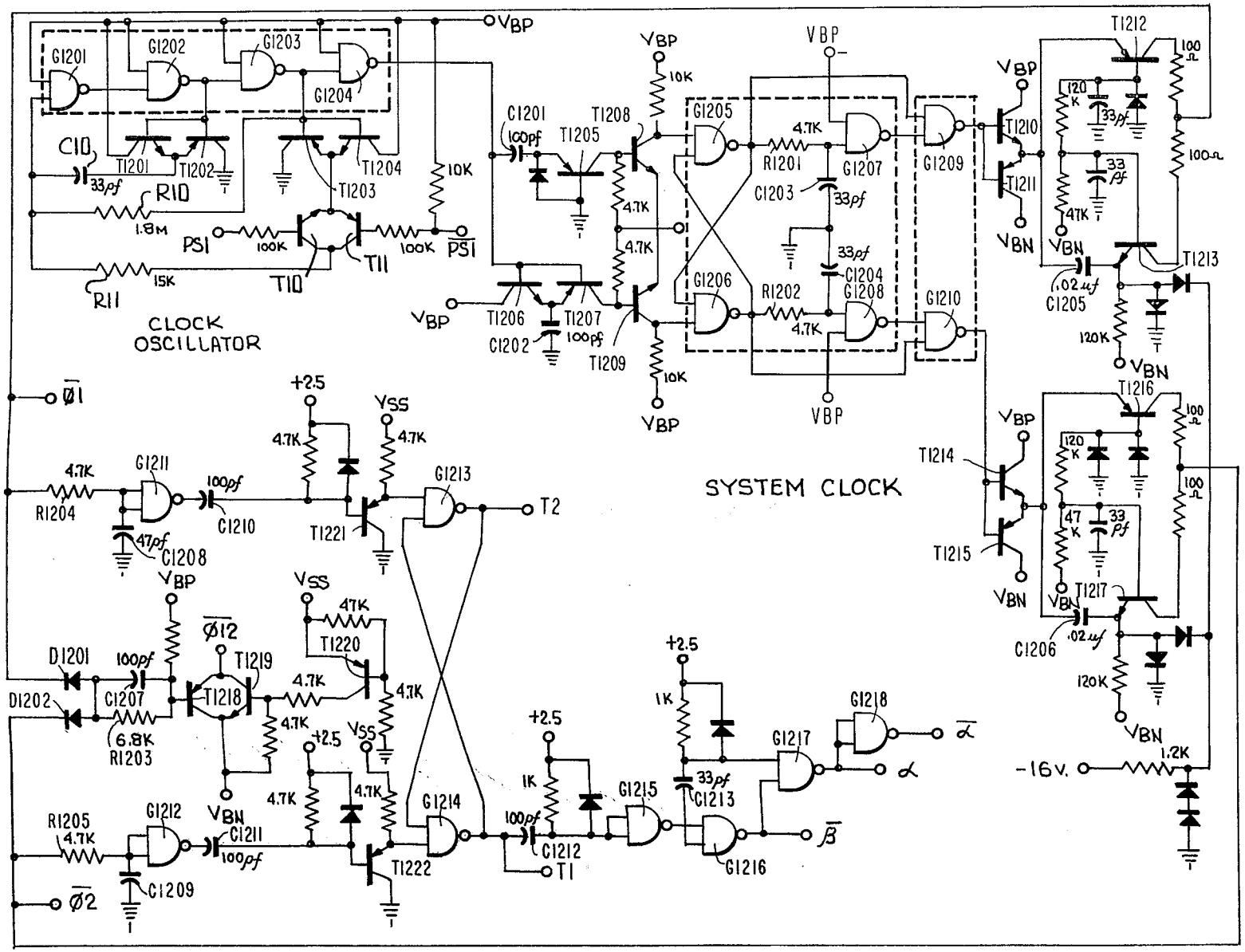
Figure 13:
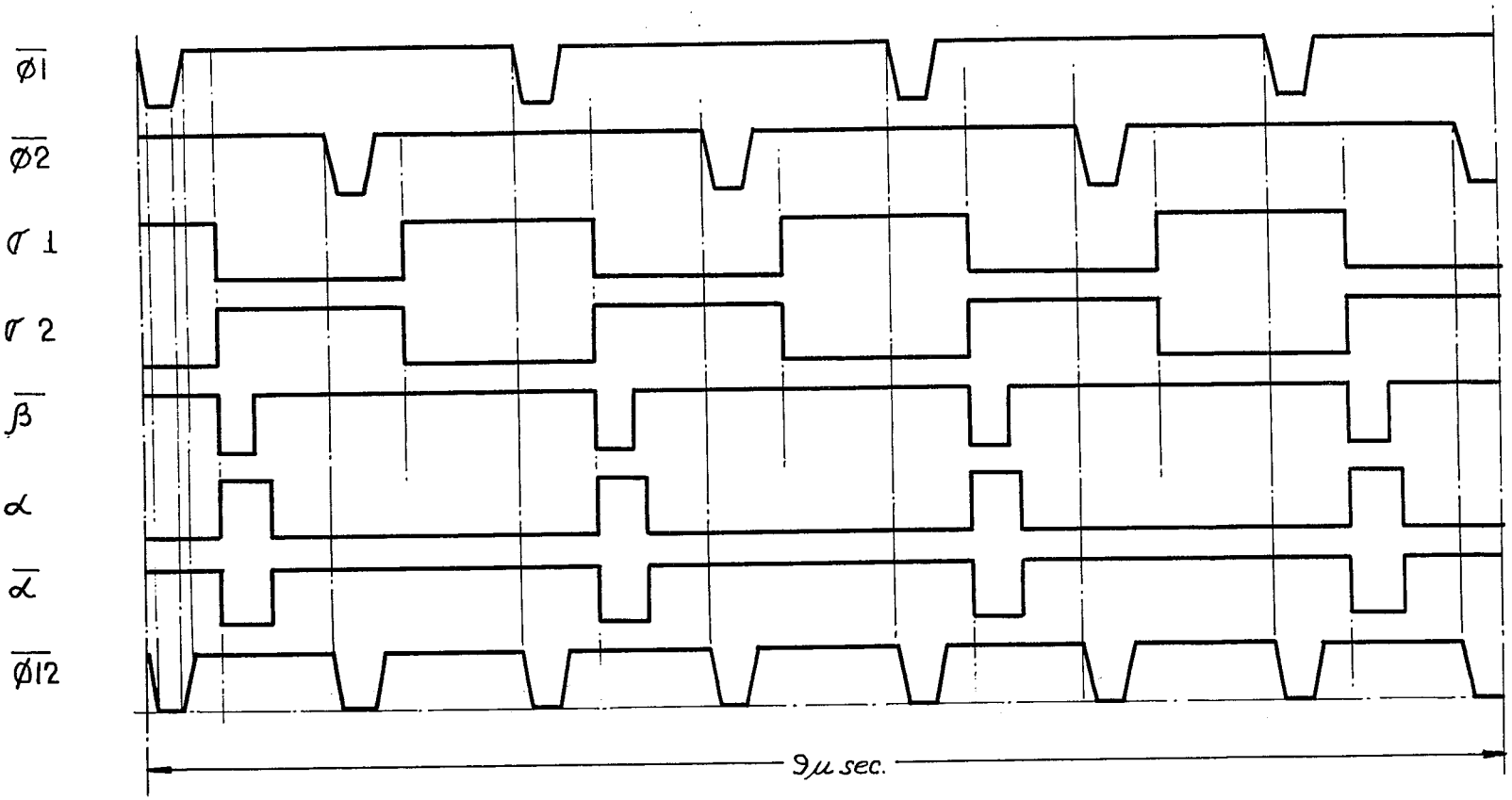
Figure 14:
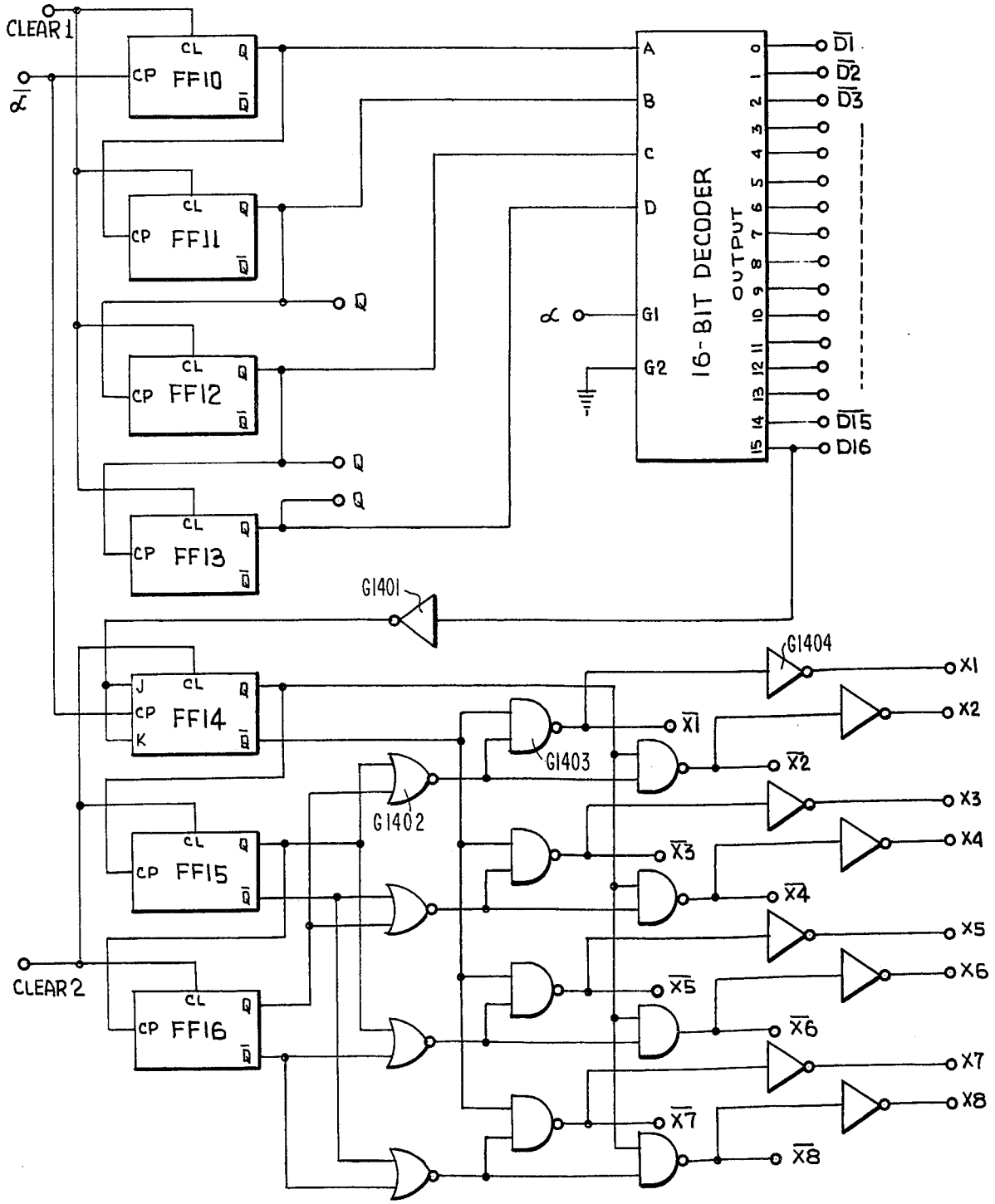
Figure 15:
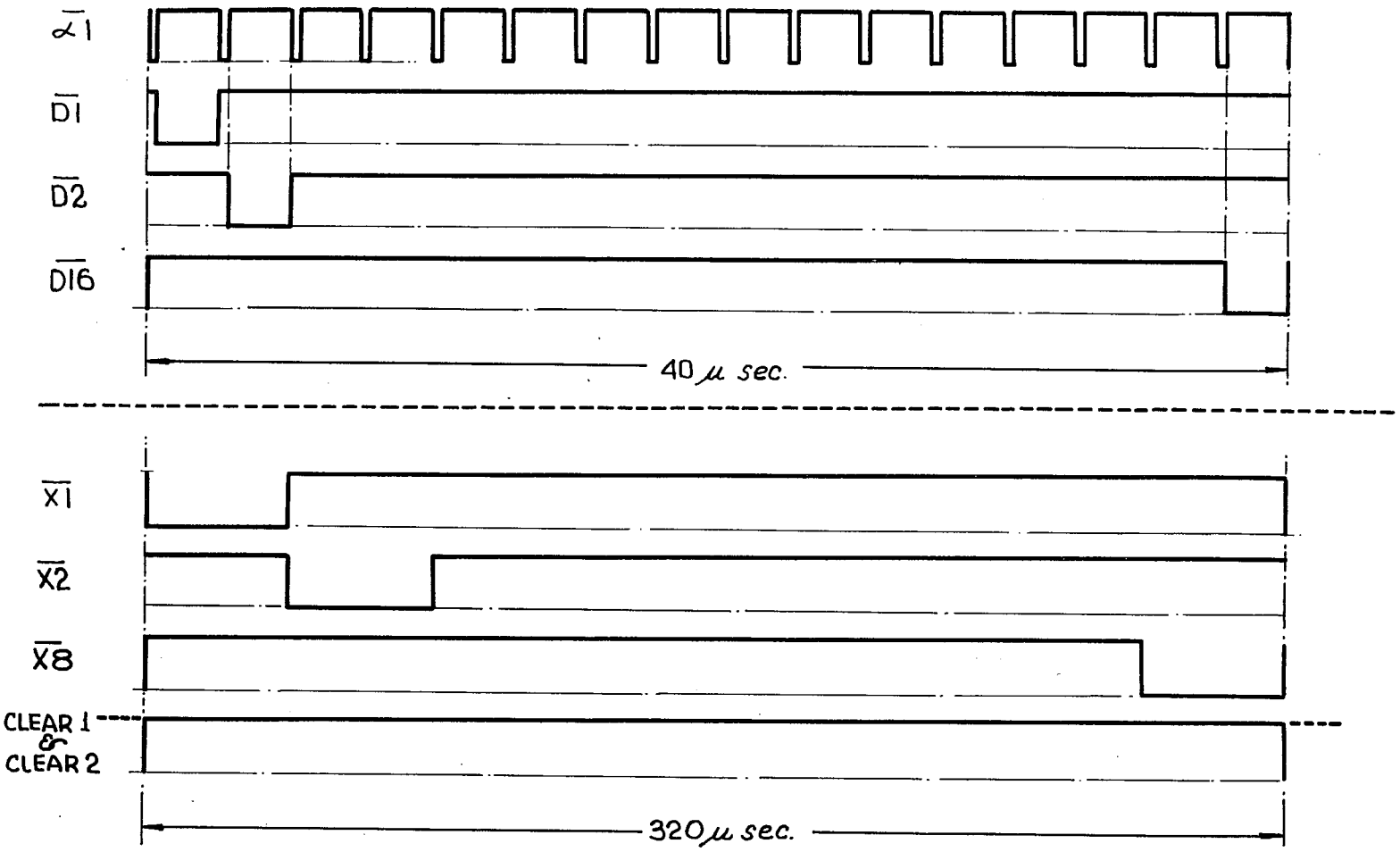
Figure 16:
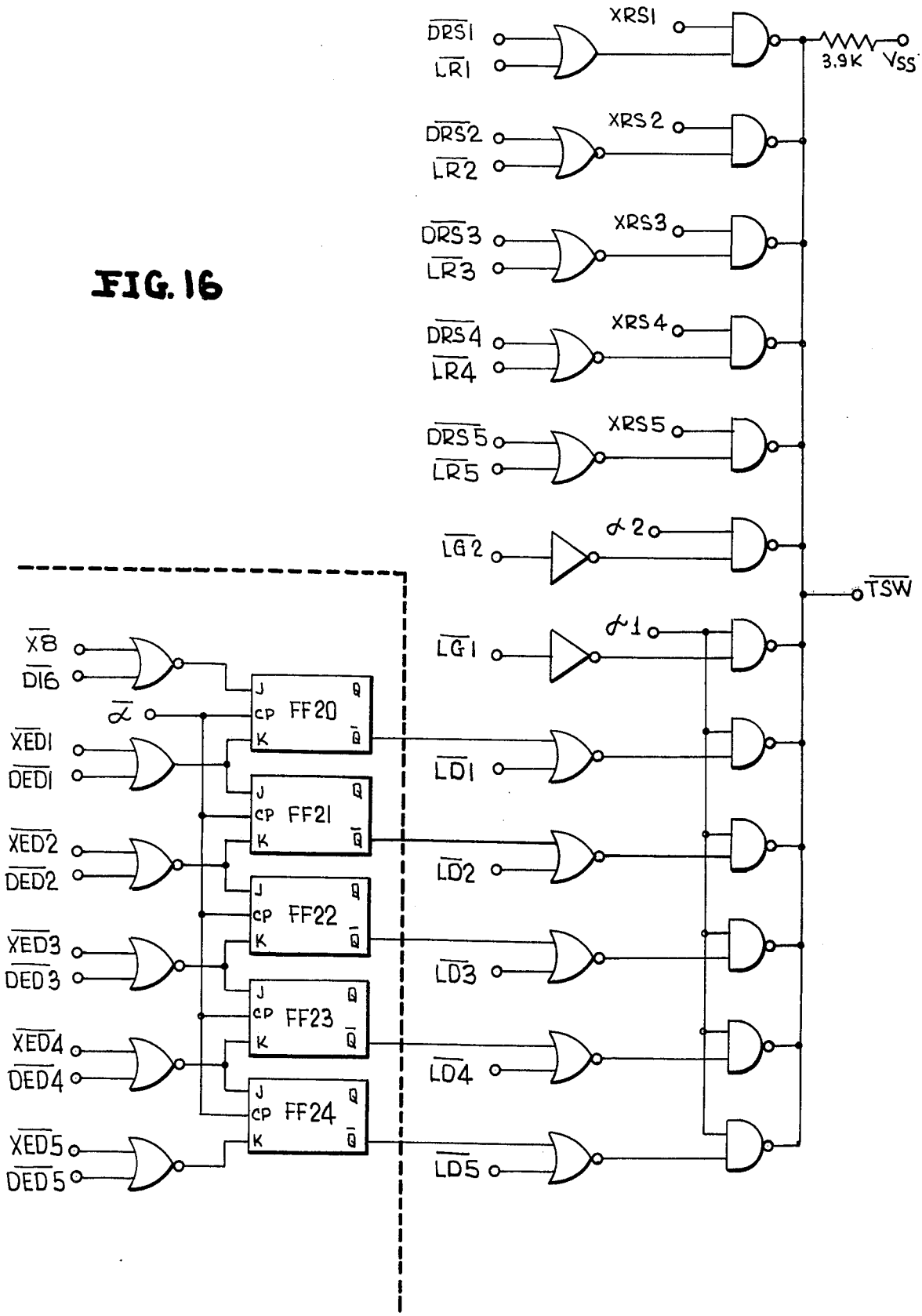
Figure 17:
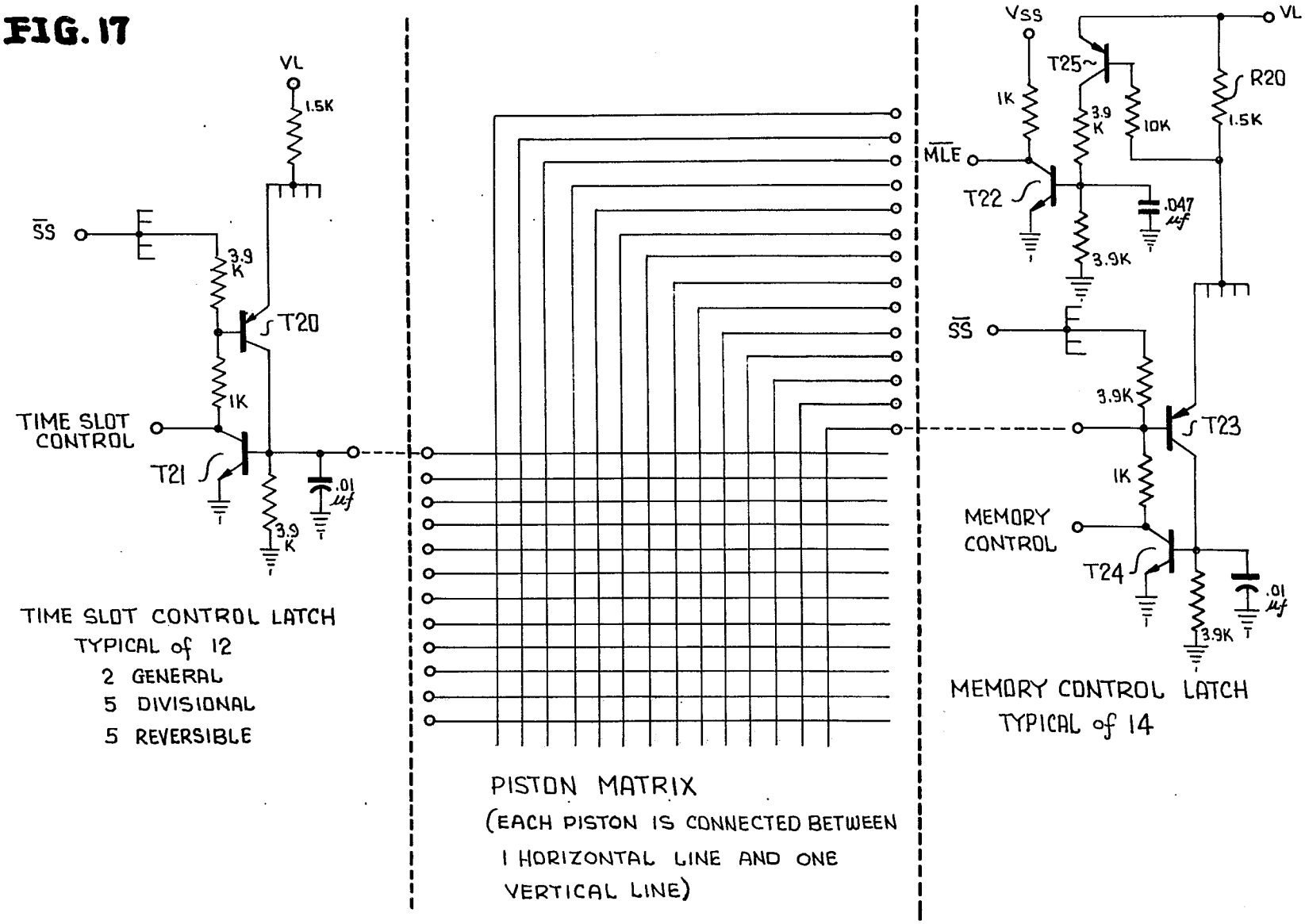
Figure 18:
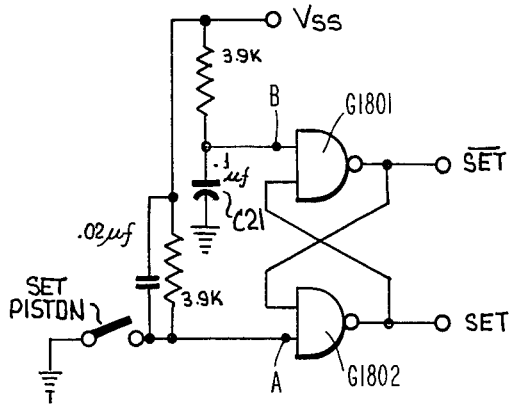
Figure 19:
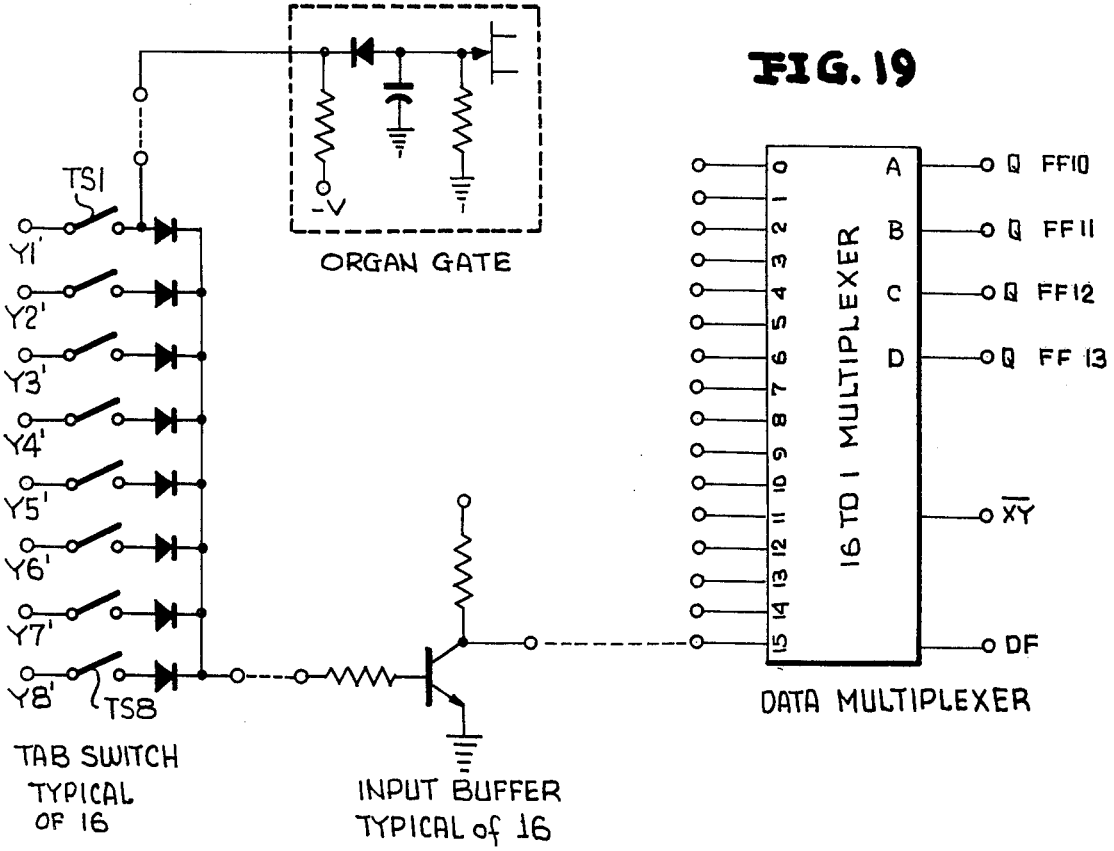
Figure 20:
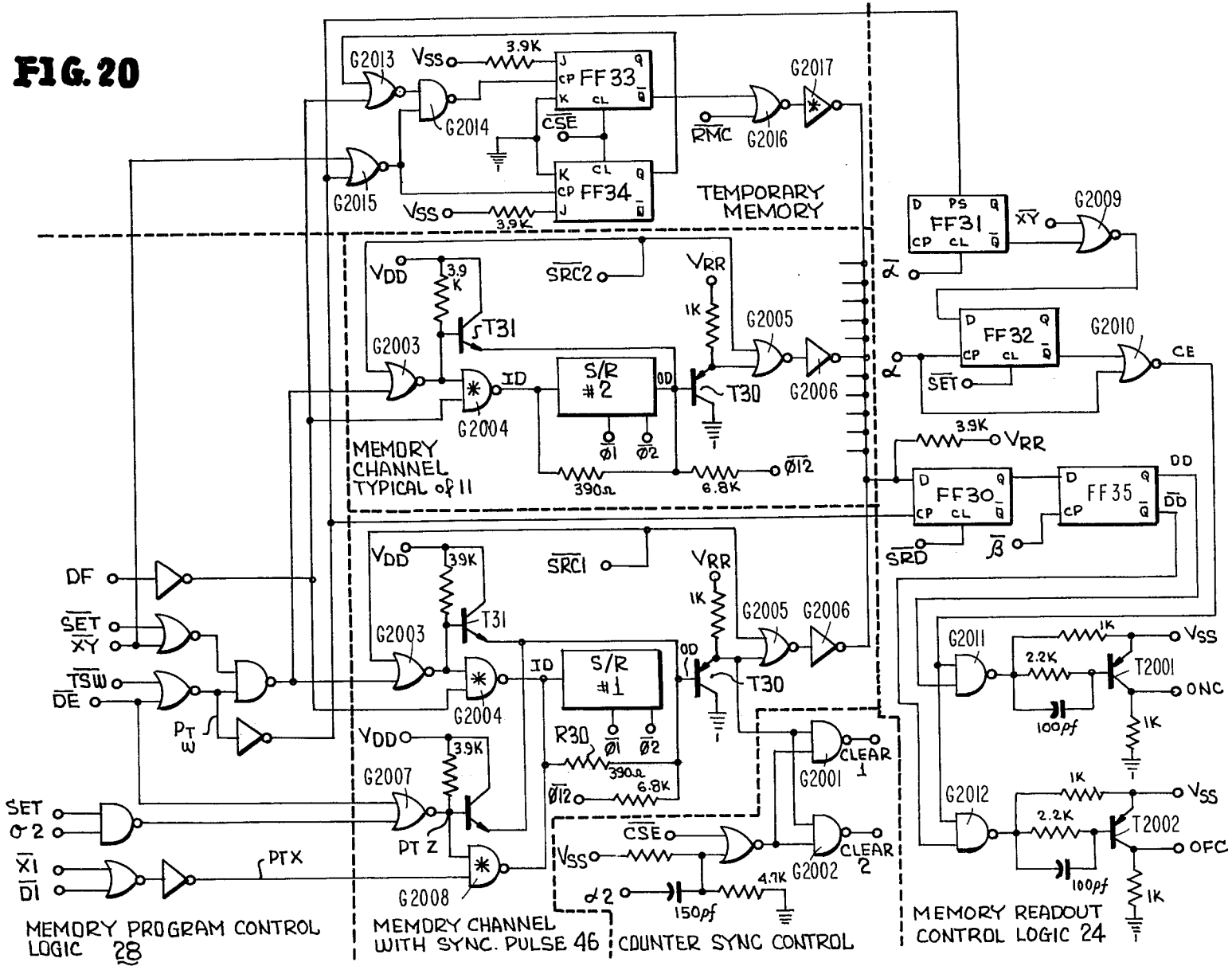
Figure 21:
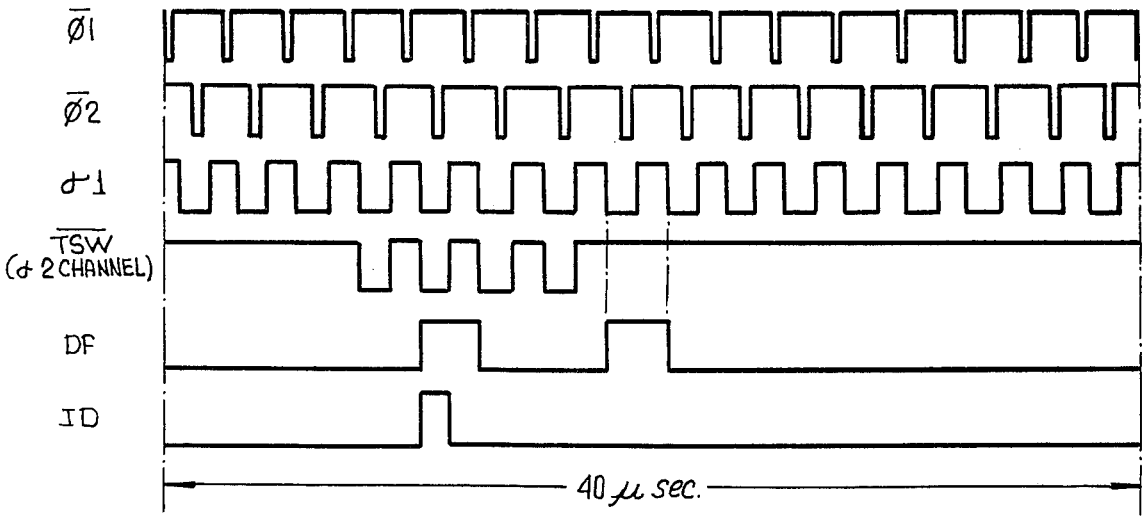
Figure 22:
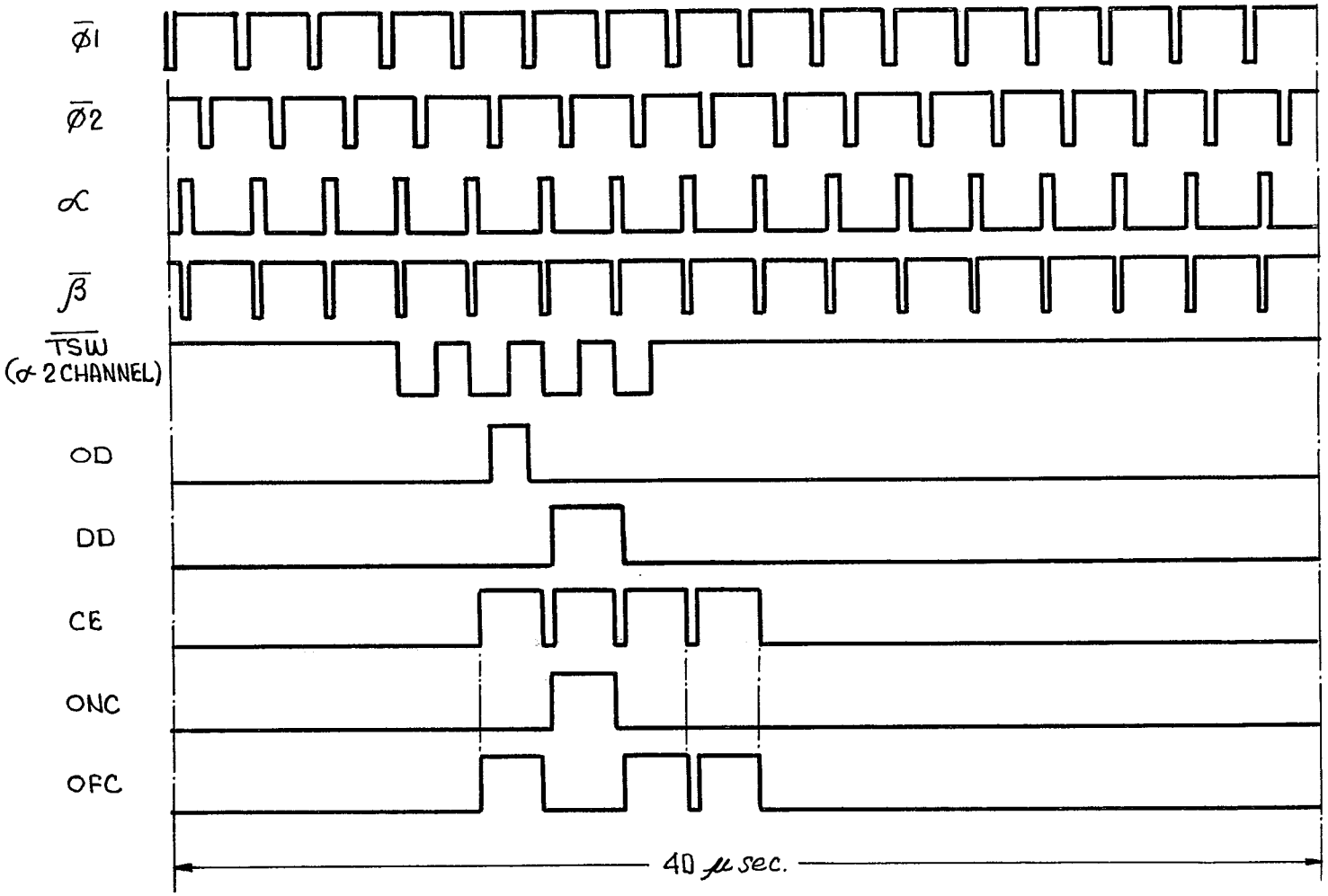
Figure 23:
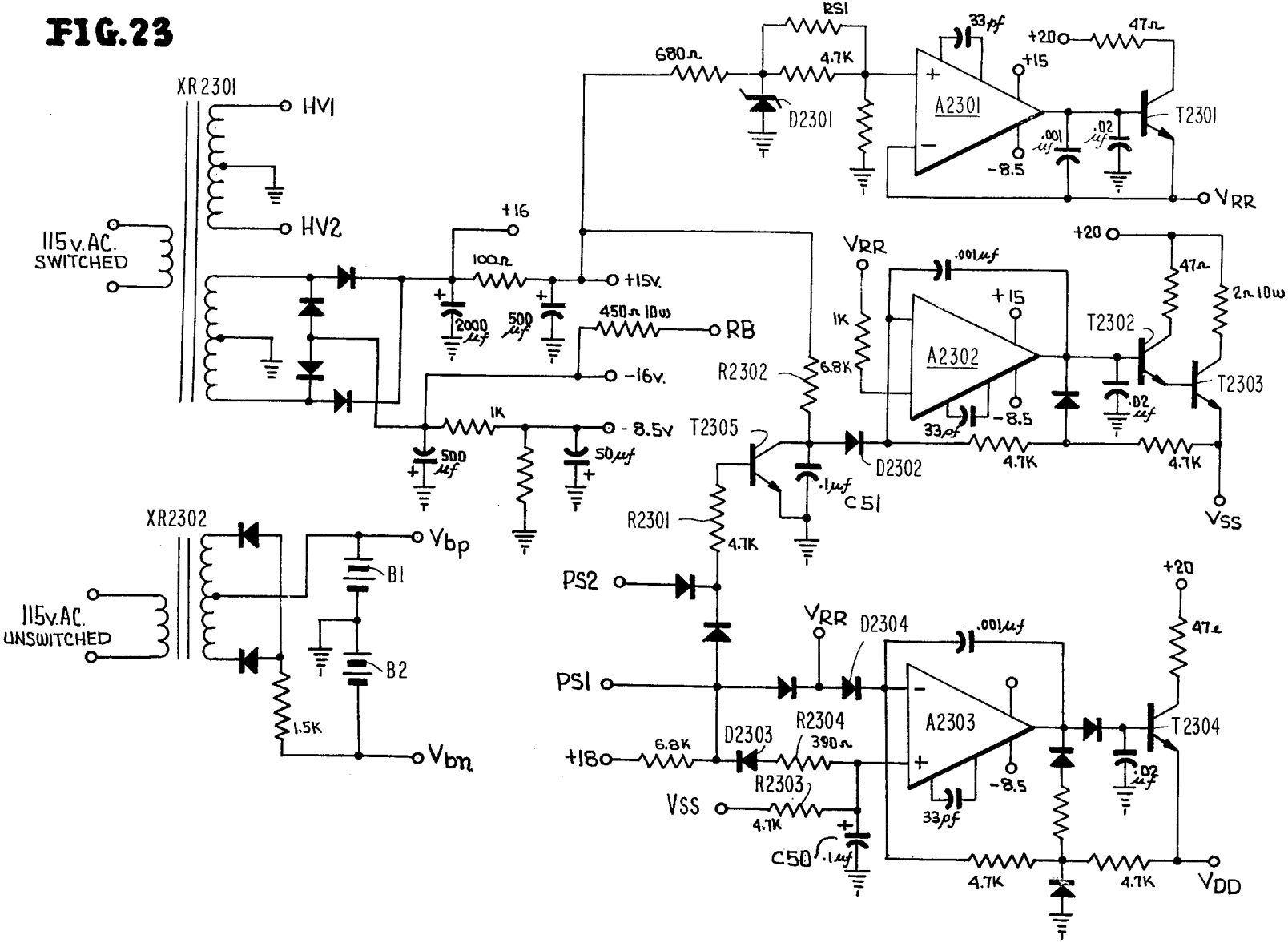

FIG. 4 provides a timing diagram for the logic of FIG. 3;

FIG. 5 is a logic diagram of a 60 Hz. line counter and decoder and a coincidence gate, in the system of FIGS. 2A, 2B;

FIG. 6 is a timing diagram for the logic of FIG. 5;

FIG. 7 is a schematic circuit diagram of a high current driver;

FIG. 8 is a circuit diagram of a tab coil schematic;

FIG. 9 is a circuit diagram of a low current driver schematic, employed in the system of FIGS. 2A, 2B;

FIG. 10 is a timing diagram for currents employed in the high current driver of FIG. 7;

FIG. 11 is a timing diagram for pulses employed in the low current driver of FIG. 9;

FIG. 12 is a circuit diagram of a system clock employed in the system of FIGS. 2A, 2B;

FIG. 13 is a timing diagram for the system clock of FIG. 12;

FIG. 14 is a logic diagram of a time slot decoder, employed in the system of FIGS. 2A, 2B;

FIG. 15 is a timing diagram for the logic diagram of FIG. 14;

FIG. 16 is a logic diagram of a memory control of FIGS. 2A, 2B;

FIG. 17 is a schematic circuit diagram of a latch matrix, in the system of FIGS. 2A, 2B;

FIG. 18 is a logic diagram of memory read-out control logic, in the system of FIGS. 2A, 2B;

FIG. 19 is a schematic circuit diagram of tab switches and tab switch multiplexer, in the system of FIGS. 2A, 2B;

FIG. 20 is a logic diagram of the memory and memory read-out control, in the system of FIGS. 2A, 2B;

FIG. 21 is a typical logic timing diagram for the memory of FIGS. 2A, 2B;

FIG. 22 is a timing diagram for memory read-out in the system of FIGS. 2A, 2B;

FIG. 23 is a power supply schematic for the system of FIGS. 2A, 2B, and

Figure 24:
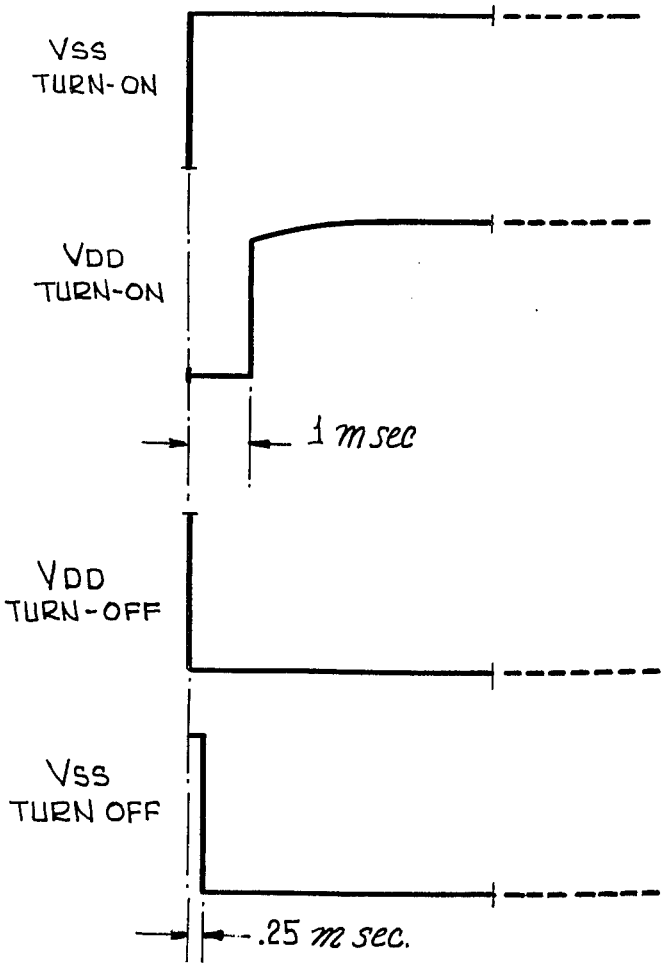

FIG. 24 is a timing diagram for the power supply of FIG. 23.

Figure 1:
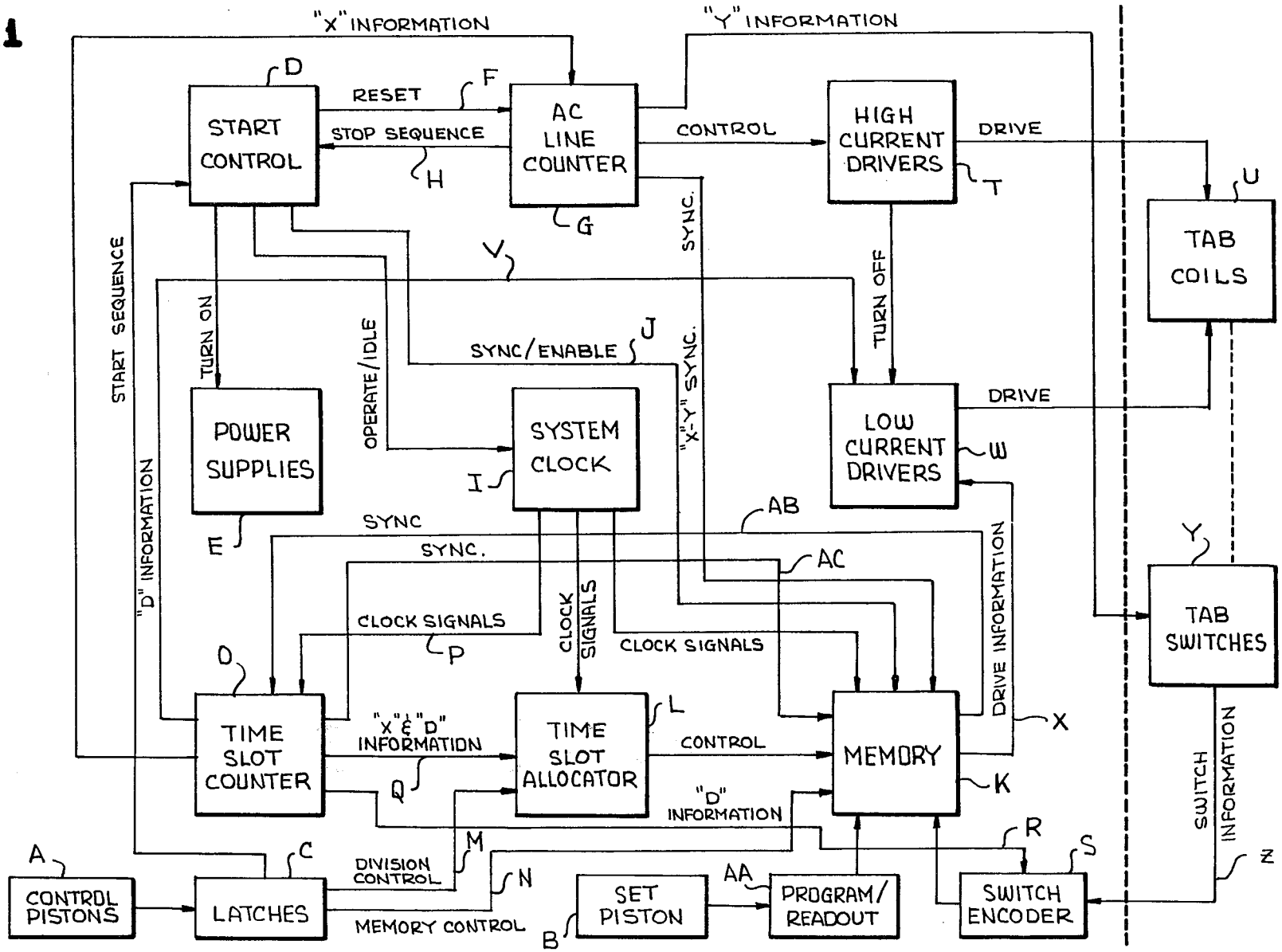
FIG. 1 is a block diagram showing signal flow in the present invention and outlining the broad organization.

Referring now more particularly to the accompanying drawings, FIG. 1 is a block diagram of the present system, in highly simplified form, which serves to provide a broad explanation of the operation, and as an introduction for the more complete block diagram of FIGS. 2A and 2B, which contain blocks keyed to the further figures of the drawings, which provide detailed circuitry and logic.

In FIG. 1, A are control pistons. These may be operated simply with a set piston B if read-in is desired, or without operating set piston B, if read-out is desired. When a control piston A is operated it sets one pair of latches C, each of which supplies signal to a start control D. The start control D turns on power supplies E (which are normally turned off), applies a signal over line F to an AC line counter G to reset the latter and then to cause AC line counter G to count through one sequence. When the AC line counter G has completed a sequence of operation it applies a stop sequence command to the start control via line H, signalling completion of a cycle of operations and turning off the power supplies. Start control D also applies a signal to the system clock I, which in the idle or standby condition, prior to actuation of a control piston, has been operating at a low frequency and causes the system clock I to operate at 400 KHz., its normal operating frequency. The start control D also provides a signal via line J to the memory K which in turn provides a signal via line AB to the slot counter O to synchronize it with the memory K, and another signal via line J to enable the memory K for operating in either its readout or read-in modes. The latch C provides division control signals to time slot allocator L and memory control signals to the memory K, respectively, via lines M and N, respectively. The system clock I provides clock signals to a time slot counter O via line P, and the time slot counter, which is a seven bit counter, provides X and D information via line Q to time slot allocator L. It also supplies D information via line R to the switch encoder S, and a sync signal to memory K via line AC. The line counter G counts 32 half cycles of line frequency, and provides control signal to the high current drivers T which supply drive current for each half cycle of the AC line counter, to the tab coils U. The time slot counter O provides D information over line V to the low current drivers W, which are also supplied with drive information over line X from the memory K.

The combination of the low current driver signals and the high current driver signals serve to actuate the tab coils which correspond with occupied time slots in the memory K. To accomplish this in response to 60 cycle line current, that current is applied via the high current drivers in parallel to groups of tab coils, the low current drivers serving sequentially to select the coils of each group. Tab switches Y, which are actuated to be set by the tab coils U, also serve via line Z to operate the switch encoder S, which in turn provides signal to the memory K concerning the locations of actuated tab switches, during read-in of information.

High current drivers T apply AC line voltage to the tab coils in eight groups of sixteen tab coils per group. These drivers also operate to force low current drivers, which are SCR circuits, to turn off at appropriate times. Time slot counter O generates 128 distinct time slots organized in eight groups of sixteen per group to encode the switch information. Time slot counter O counts in response to signal received from the system clock via line P and provides reference information to the memory and synchronization to the memory, and accepts a synchronization pulse from the memory. The time slot counter also provides X and D time slot information to the time slot allocator L. The latter receives time slot information to organize the tabs into divisions selected by the individual latches, and receives clock phase information to generate control signal for the memory.

The latches themselves receive information from the control pistons and store this information during an operating sequence. They generate start sequence signals and generate information to allow the time slot allocator and the memory to determine the function to be performed.

The memory itself stores synchronization information and reads it out during the sync mode. It accepts information from the latches to determine which location in memory is to be accessed for read-in or read-out, accepts encoded tab switch information and encodes and reads out coil drive information during the enable mode. The memory also accepts information from the program read-out control AA to determine whether to store information or to read it out to the coil drivers. The switch encoder S performs a multiplexing operation on the tab switch information to condition it for acceptance by the memory K. The program/read-out control AA insures that the memory K is configured to read out information except when set piston B is depressed and when the latter is depressed to read information into the memory. The low current drivers W accept information from the memory and in response to that information determine whether tabs should be turned off or should be turned on, and transfer this information to the appropriate ones of the tab coils U. The operation of the system of FIG. 1 has been very briefly described to provide a rough outline. A complete block diagram of this system is provided in FIGS. 2A and 2B, but the nomenclature of the blocks in FIG. 1 is not the same as in FIGS. 2A and 2B because of circuitry differences among the several blocks, and to avoid confusion as to which one of the circuit diagrams is being discussed.

Referring to FIGS. 2A and 2B, a mode sequence control 10 provides three modes of operation, an idle mode, a read-in mode and a read-out mode.

In the idle mode the memory 12, containing twelve shift register memory channels and a temporary memory channel, contains information previously inserted. The mode sequence control 10 is powered during the idle mode. The system clock 14 is then operating at 8 KHz., and memory 12 has power. The remainder of the system is shut down, to save power. The power supply during the idle mode is a ±battery, which supplies power during standby for the shift register memory 12, and for the clock 14 and for the mode sequence 10.

To set the system in operation to read in data, where that data is tab settings, the set piston 16 is operated simultaneously with a control piston 18. The set piston 16 operates a program readout control 20, which transfers a signal over line 22 to memory readout control logic 24, and over line 26 to memory program control logic 28.

The selected one of control pistons 18 supplies control to a piston latch matrix 30. The latter includes fourteen latches connected to the vertical lines of the matrix 30 and twelve latches connected to the horizontal lines of the matrix 30. Each control piston 18 connects a horizontal line to a vertical line of the matrix 30. Each of the latches actuated by the control piston 18 then applies a start pulse to the mode sequence control 10, via line 32. In response to this pulse, the mode sequence control 10 turns on the power supplies, and causes the clock, which had been running at its low idle frequency, to run at its normal frequency of 400 KHz. and applies a reset pulse over line 34 to a 3 bit 60 Hz. line counter and decoder 40 to reset the latter. The counter is clocked directly from 60 Hz. power.

A sync pulse is read out of memory 12, via one of thirteen lines 42, into the memory readout control logic 24, and the latter directs a pulse over line 44 to the counter sync control 46. The latter in turn directs a pulse over line 48 to a 7 bit 400 KHz. counter and decoder 50, to clear the latter and reset it to its initial state, synchronizing it to the memory.

At this stage in the system operation the 60 Hz. counter 40 and the 400 KHz. counter 50 have been reset, and the selected control piston latches have been latched.

The matrix 30 has fourteen vertical lines. Leads from these, 52, proceed to memory horizontal control logic 24, and to memory readout logic 28. These lines represent twelve permanent memory lines plus one line for reversible control and one line for cancel control.

The piston latch matrix also provides twelve output lines 62 deriving from the horizontal buses of the matrix to the programmable time slot decoder and piston gate 64. These twelve lines represent respectively, five divisional pistons of the organ, two generals and five reversibles. One of these lines is latched by any actuated piston.

The system clock 14 feeds clock and gating pulses, via line 66, to the programmable time slot decoder and piston gate 64. If a division piston is selected only the time slots appropriate to that division are enabled or strobed. If it were a general piston all time slots would be enabled, and if it were a reversible piston, one time slot for the corresponding stop tab would be enabled.

The system clock is a two phase clock. One of these phases operates the decoder and piston gate 64 and transfers the information in the decoder and gates 64 via a single line 67 to memory program control logic 28.

The system has previously directed control piston information into program control logic 28, so that it may enable the appropriate memory channel.

The 7 bit 400 KHz. counter and decoder 50 supplies signal to coincidence gates 80, via eight lines, providing time slots X. The 60 Hz. line counter and decoder 40 provides 8 lines out, providing time slots Y. The coincidences $\overline{XY} = \overline{(X1Y1 + X2Y2 + X3Y3 + X4Y4 + X5Y5 + X6Y6 + X7Y7 + X8Y8)}$ are fed via line 82 to tab switch multiplexer 84 and to memory readout control logic 24 and to memory program control logic 28.

The tab switches 86 which are actuated serve to direct the 8 time slots Y which are provided by 3 bit 60 Hz. counter 40, on eight lines 85, to the tab switch multiplexer 84 as sixteen lines 88 each having 8 tabs encoded, and the latter, controlled by the $\overline{XY}$ information and the output of the 7 bit 400 KHz. counter and decoder 50 translates the tab information into one line 90, applied to the memory program control logic.

The tab switches are divided into groups, each group containing as many as 16 tab switches, so that the outputs from the tab switches are sixteen lines, each having eight possible bits of information encoded on it, depending on which one of the Y time slots was fed to a given tab switch.

The tab switch multiplexer, under control of the 7 bit 400 KHz. decoder 50 translates the tab switch data into the one line 90 of information. The multiplexer 84 is provided with 16 time slot positions by counter and decoder 50 via four lines 94. The sixteen bit multiplexer encodes the D time slot by scanning the sixteen lines from the tab switches 86, and strobing from $\overline{XY}$ insures that the information in respect to a tab switch is encoded in the appropriate X time slot.

Essentially, multiplexing occurs in two steps: at the tab switches 86, 128 tabs are multiplexed into sixteen lines, each having the time slots Y. At the multiplexer 84, the sixteen lines are multiplexed onto one line 90 translating the 128 time slots to the X and D reference.

A synchronization pulse, X1–D1, from the counter decoder 50 via line 97 is applied to the memory program control logic 28 in combination with a gating pulse from the system clock 14 via line 96 and is stored in memory. This is required to synchronize the system prior to read-in or readout.

The third operating mode is readout mode. In this case the set piston 16 is not actuated. A control piston is actuated, and it is desired to read out and automatically actuate the tabs which were previously stored in memory, when that same piston was actuated and the set piston also operated.

Actuation of the selected control piston starts the operating sequence. The mode sequence control 10 resets the 60 Hz. line counter and decoder 40 and causes the memory read out control logic 24 to produce a sync pulse to reset the counter and decoder 50. By this time the piston latch matrix 30 has set latches located in one horizontal line and one vertical line, corresponding with the actuated piston. The vertical latch, one of fourteen, directs signals to the memory readout control logic 24, to select one channel, there being twelve memory channels in the memory 12, which contains the required information. The horizontal latch selected by the piston comes through the programmable time slot decoder and piston gate 64. The selected time slots are strobed by the appropriate clock phase into the memory program control logic 28 and combined with data enable and sent to the memory readout control logic 24, there combined with $\overline{XY}$ to enable the data to be fed out. The information is in X and it is desired that the information be read out corresponding to Y. The coincidence of X and Y provides $\overline{XY}$, which enables readout in Y.

The read out information appears on two lines 100, one an "on" line and the other an "off" line, i.e., the data on these lines are complements of each other. These lines 100 are directed to output drivers 102. The latter represent a matrix of eight high current drivers and sixteen pairs of low current drivers. The latter are clocked from counter and decoder 50, via lines 106, including sixteen lines containing sixteen time slots D. The high current drivers are actuated from the 60 Hz. counter 40, lines 108, including eight lines, and eight time slots Y.

During each Y there is time to scan the memory 12 for the information to be read out via lines 100. When the information appropriate to the tab coils 110 contained in, say Y1, is scanned during Y1 it operates the output drivers 102, firing one of each pair of sixteen low current drivers determining whether the tab switches 86 will be turned on or off. The coincidence signal $\overline{XY}$ selects the appropriate sixteen of the bits of information stored in the memory 12, corresponding to the sixteen tabs in Y1.

At the next half cycle of line frequency a second set of coils is controlled, to set their tabs on or off, from the same sixteen pairs of low current drivers, but a different high current driver. It follows that the low current drivers, which are SCR's, must be allowed to turn off between successive half cycles of the 60 Hz. signals Y.

FIG. 3 is a circuit diagram of the mode sequence control schematic, represented at 10 in FIGS. 2A, 2B, and FIG. 4 is a logic timing diagram for the system of FIG. 3. Various terminals in FIG. 3, whether they are input or output terminals, are labelled. Details of the circuitry are not discussed since only conventional logic is involved.

In FIGS. 3 and 4, $\overline{SS}$ represents an input pulse terminal, the pulses being derived from latches 30, indicating that a control piston 18 has been depressed. PS1 and $\overline{PS1}$ provide signal to power supplies to turn them on during operational sequences and to set the clock 14 of the system into the operate mode. L3 provides an input for a pulse from AC line counter 90 which serves to synchronize operation with the AC line voltage. $V_L$ is a voltage source which enables the latches to hold the control piston information during an operational sequence of the system. $\overline{Reset}$ provides a pulse to clear the AC line counter at the beginning of an operational sequence. $\overline{QFF3}$ provides a pulse from the AC line counter to configure the system in the enable mode. $\overline{CSE}$ provides a signal to the memory to configure it in the sync mode. Y8 represents an input terminal receiving a pulse from the AC line counter used to count down the stop sequence command, which turns off the power supplies, i.e., line H of FIG. 1. PS2 provides signal to the power supplies to turn them on during the start up sequence. $\overline{MLE}$ receives signal from the latches to inhibit the enable mode when the memory channel is not latched in, $\overline{DE}$ provides signal to the memory to configure it in the enable mode, and DL3 provides signal to inhibit generation of L3 sync pulses more than once during an operational sequence.

The initial configuration of the system is that the following output commands are present: $\overline{PS1}$, $\overline{CSE}$, $\overline{DE}$, $\overline{DL3}$ are logic 1. At this point a control piston 18 is depressed and the $\overline{SS}$ pulse is then received in response to operation of the control piston 18. The $\overline{SS}$ pulse is amplified and shaped by the circuitry of T301 and T302 and connected via line L301 to G302. G301 and G302 are NAND gates connected as a set-reset flip-flop and the $\overline{SS}$ pulse from T302 causes the flip-flop to become set and PS1 becomes a logic 1, $\overline{PS1}$ becomes a logic 0. G304 and G305 are also connected as a set-reset flip-flop and the $\overline{SS}$ pulse from T302 causes this flip-flop to become set and DL3 becomes a logic 0. This logic 0 at DL3 is connected to G306 and thence to the circuitry of T303, turning T303 off and disabling $V_L$. L3 is then received in synchronization with the AC line, coupled through G303 and G308. G307 and G308 are NAND gates connected as a set-reset flip-flop. The L3 pulse causes this flip-flop to become set. $\overline{CSE}$ becomes a logic 0, the $\overline{RESET}$ pulse is generated, the input to G309 becomes a logic 1, and the signal connected to G306 via line L302 continues to disable $V_L$. The L3 pulse is also connected to G305 through line L303 causing the flip-flop comprised of G304 and G305 to become reset and DL3 becomes a logic 1.

When the AC line counter counts to one QFF3 becomes a logic 0. The flip-flop comprised of G307 resets and $\overline{CSE}$ becomes a logic 1. This signal connected via line L302 to G306 causes T306 to turn on and $V_L$ is enabled. The output from G308 is connected to the set-reset flip-flop comprised of G310 and G311, causing this flip-flop to become set. The resulting logic 0 output of G310 is connected to G309 via line L303, causing PS2 to remain a logic 1. The logic 1 output of G311 is connected to G312 via line L304. The logic 1 value of $\overline{CSE}$ is connected to G312 via line L305 and the logic 1 value of PS1 is connected to G312 via line L306. When $\overline{MLE}$ becomes a logic 0 it is inverted by G313 to a logic 1 and connected to G312 via line L307. Now the four input conditions for NAND gate G312 being satisfied, $\overline{DE}$ becomes a logic 0.

The above actions cause Y8 to make a transition to logic 0 for times. $\overline{DE}$ thereafter becomes a logic 1, PS2 becomes a logic 0, causing PS1 to become a logic 0, and $\overline{PS1}$ to become a logic 1. The sequence of operations now terminates, and substitute thereof — This causes the 2 bit counter comprised of FF1 and FF2 to count to four at the end of which there will be a negative transition at the Q output of FF2. This transition causes the flip-flop comprised of G310 and G311 to become reset. The resulting logic 0 at the output of G311 is connected to G312 via line L304 causing $\overline{DE}$ to become a logic 1. The logic 1 output of G310 is coupled via line L303 to G309 causing PS2 to become a logic 0. This last is connected via line L308 to the flip-flop comprised of G301 and G302 causing that flip-flop to reset and PS1 becomes a logic 0 and $\overline{PS1}$ becomes a logic 1. The conditions of all gates and signals are now returned to the initial conditions and the sequences of operations now terminate.

If a control piston is operated during an operational sequence, it causes the cycle to restart, again an $\overline{SS}$ pulse is received which causes DL3 to become a logic 0, and to FIG. 24 which shows the timing of the events described, and $V_L$ to become disabled. $\overline{MLE}$ then becomes a logic 1, causing $\overline{DE}$ to become a logic 1. Operation then continues in accordance with the previously described operation.

When power is first supplied to the system the states of the various flip-flops are undetermined. Any flip-flop may be configured incorrectly, which may cause PS1 or PS2 to be a logic 1, and the system then operates in accordance with the normal sequence of operations until the sequence stops. However, $\overline{MLE}$ will be a logic 1 causing $\overline{DE}$ to remain a logic 1 throughout the sequence. The timing of the various signals referred to in FIG. 3 over 16 cycles of 60 cycles current is shown in FIG. 4.

Referring to FIG. 5 of the drawings for which FIG. 6 provides timing diagram, AC signal for the power supply is applied to the terminal HV1 and serves as a clock for an AC line counter. $\overline{L1}$ represents a lead carrying a square signal derived from the signal applied to HV1, and which is delayed approximately 12° with respect to HV1. $\overline{L2}$ is an internal signal which is compatible with $\overline{L1}$, but which is delayed approximating 30 degrees with respect to the signal HV1. L3 represents a pulse terminal, the pulse being used as a control to synchronize start of the various system components with the AC line. DL3 is an input signal which causes inhibition of the L3 pulse more than once during an operational sequence. $\overline{QFF3}$ is a pulse which proceeds to the mode control 10 and is used to configure the system in the enable mode. Y1 through Y8 are sequential pulses deriving from the AC line counter, corresponding with half cycles 1 through 8 of the AC line voltage, to apply pulses to high current drivers for the tab coils. Y1′ through Y8′ are buffered AC line counts 1 through 8 and provide signals used as multiplexing drive for the tab switches. $\overline{RESET}$ receives a signal pulse to clear the AC line counter at the beginning of an operational sequence. X1 through X8 are input signals from the decoder 50 used to generate $\overline{XY}$, a synchronization signal. When supply voltage $V_{ss}$ is applied to the logic circuitry, the system is enabled to count in synchronization with the AC line. An L3 pulse is generated at the appropriate time and proceeds to the mode sequence control where a $\overline{RESET}$ is generated. At this point the $\overline{RESET}$ pulse is received, it being a negative pulse, and it clears the AC line counter flip-flops to initial condition ready to receive counts. As the circuit counts in synchronization with the AC line, pulses Y1 through Y8 are generated in succeeding half cycles of the AC line, with the first 30° approximately of each half cycle providing a guard band between successive Y's. At count 1, which is 30° into the first half cycle following application of the $\overline{\text{RESET}}$ pulse, $\overline{Q}$ undergoes a negative transition, providing an output pulse which is used in the start control to configure the system in the enable mode. Whenever $Y_n$ and $X_n$, $n$ being equal in the two cases, occur simultaneously $\overline{XY}$ becomes a logic 0. This information is used for synchronization within the memory of the system. When a sequence has been completed, $V_{ss}$ power is removed from the logic circuitry, and counting then stops. However $V_{rr}$ which is a supplementary power source remains supplied to the signal conditioning circuitry, for standby purposes. $\overline{L1}$ and $\overline{L2}$ are continuously generated to preclude the possibility of erroneous phase angle on start up. The derivation of $\overline{L1}$ and L3 is now described.

HV1 is phase shifted approximately −6° through the action of the 10.K resistor R1 and the 0.033μf capacitor C1. Transistors T2 and T3 act to amplify the signal so that switching will occur at zero crossings. The feedback network consists of 0.01μf capacitor C2 with a 27.K resistor R2, providing an additional phase shift of −6°, or a total phase shift of −12°. Transistor T4 inverts the signal creating $\overline{L1}$. A signal is fed through the 0.0001μf capacitor C3, and causes a positive pulse L3 of short duration to appear at the collector of transistor T5, but only when transistor T1 is not conductive. T1 is conductive whenever DL3 is a logic 1.

Pulse $\overline{L2}$ is derived in a manner similar to $\overline{L1}$, except that the feedback network consists of 0.056μf capacitor C4 and 27.K resistor R4, to provide an additional phase shift of approximately −24°, for a total phase shift of −30°.

The pulses $\overline{L1}$ and $\overline{L2}$ are combined in gates G501, G502 and G504 and connected to the 2-bit counter consisting of FF3 and FF4 and to that portion of the 8-bit decoder consisting of gates G513, G514, G515 and G516.

The outputs from FF3 and FF4 are connected to that portion of the 8-bit decoder consisting of gates G505, G506, G507 and G508.

The 8-bit decoder consists of the gates G505, G506, G507, G508, G509, G510, G511, G512, G513, G514, G515 and G516. This decoder is driven by $\overline{L1}$, $\overline{L2}$, and the outputs of FF3 and FF4 produce 8 sequential, non-overlapping pulses Y1 through Y8, as shown in FIG. 6.

The Y′ buffer circuit consisting of the circuitry of transistors T501 and T502 is used to condition the Y1 through Y8 pulses to drive the tab switches in the organ and is used to maintain a virtual ground at the tab switches while the combination action is in the idle mode, that is, $V_{ss}$ turned off, so that the organ circuits will continue to operate.

The coincidence gates consisting of G517, G518, G519, G520, G521, G522, G523 and G524 receive the Y pulses and the X pulses from the time slot counter 50 in such a manner that the terminal $\overline{XY}$ has a logic 0 only when X1 and Y1 or X2 and Y2 or X3 and Y3 or X4 and Y4 or X5 and Y5, or X6 and Y6, or X7 and Y7 or X8 and Y8 are in coincidence.

FIG. 6 is a timing diagram showing the relative timing of the signals appearing in FIG. 5.

Reference is made to FIG. 7 of the accompanying drawings, illustrating a high current driver schematic and to FIG. 10 which shows the timing of currents flowing in FIG. 7, and in FIGS. 8 and 9. To the terminal $Y_n$ are applied control pulses for the high current drivers. These control pulses constitute the pulses Y1 through Y8 corresponding with AC line count 1 through 8, and $Y_n$ represents a typical Y pulse. The terminal HV1 is connected directly to one terminal of a push-pull drive transformer T which is driven directly from AC power. The terminal $CP_n$ is connected directly to the cathode of the SCR $HCD_n$ and supplies current to sixteen on coils and sixteen off coils, identified as ONC and OFC in FIG. 8 of the drawings. The terminal RB is referenced to −16.v through a 450 ohm resistor.

In operation $Y_n$ undergoes a positive transition causing transistor T701 to conduct. The resulting negative transition at the collector of T701 is fed through R701, D701, R702 and C7 to the base of T7 causing T7 to conduct. Collector current in T7 fires SCR $HCD_n$ applying power to terminal $CP_n$.

The rise in voltage at $CP_n$ is fed through capacitor C8 to the emitter of T7 holding that transistor in conduction long enough to insure that SCR $HCD_n$ is fully turned on.

Current flows through the terminal RB raising its potential and providing sufficient current flow to maintain conduction in $HCD_n$ if no current is flowing through $CP_n$. The voltage on the anode of the SCR $HCD_n$ eventually decreases through zero volts, since it is connected directly to AC. When current in the SCR $HCP_n$ falls to its holding current, the SCR $HCD_n$ turns off. The cathode of $HCD_n$ then falls to the reference voltage of −16 volts. The capacitors C7 and C8 are then recharged by current from +16 volts to RB after $TC_n$ turns off.

Referring now to FIG. 8 of the drawings, when voltage is applied to $CP_n$ and a low current driver SCR is turned on, current flows through the on coil or the off coil and the corresponding series diode D801 or D802 depending on whichever of the pair of SCR's in the low current driver is turned on. The stop tab is actuated. When the voltage at $CP_n$ falls through zero volts, current ceases to flow through terminals $CP_n$ and $OND_m$ or $OFD_m$. The parallel diode D803 or D804 conducts to permit the magnetic field in whichever coil had been energized to collapse.

Referring now to FIG. 9 of the drawings, terminal $\overline{Dm}$+1 receives signal from the counter and decoder 50 which is used to decode information from the memory. At the same time an encoded signal from the memory is applied to the terminals ONC and OFC to drive the coils associated with a given time slot Dm. The terminal OFC receives a signal from the memory if the off coil is to be energized and ONC receives the signal if the on coil is to be energized. RB receives a signal from the high current drivers and presents a bias voltage which, when positive, provides holding current to the SCR's in the low current driver and, when negative, forces the SCR's to turn off, the terminals RB of FIGS. 7 and 9 being directly interconnected. The terminal $OND_m$ of FIG. 9 is connected to the corresponding terminal of the ON coil, providing a path through the silicon controlled rectifier SCR1 to ground and the terminal $OFD_m$ of FIG. 9 is connected to the off coil terminal $OFD_m$ providing a path through silicon controlled rectifier SCR2 to ground. When $\overline{Dm}$+1 is a logic zero, and ONC is a logic 1, the drive transistor T8 for $OND_m$ conducts, firing the appropriate SCR1, which provides a current path for the on coil to ground. If $\overline{D}m+1$ is a logic zero, but OFC is a logic 1, T9 conducts firing SCR2, which then provides a current path for the off coil to ground. When the current in $HCD_n$ (FIG. 7) falls below holding current, the latter turns off and RB falls to the negative reference voltage. This biases the anodes of the low current SCR's, SCR1 and SCR2, forcing these to turn off very rapidly.

The circuit of FIG. 8 is typical of 128 pairs of coils which actuate 128 stop tabs on or off. The circuit of FIG. 7 is typical of eight such circuits powered from a single transformer T. In FIG. 9 are indicated 16 low current driver circuits, each of which provides current paths for eight pairs of tab coils (or N/A pairs of coils where N is the number of stop tabs and A is an integer divisible into N) respectively connected to each of the eight high current drivers of FIG. 7. When the 320 microseconds required to scan the memory and fire the sixteen low current drivers has been completed at the start of a $Y_n$ time period (7.5 milliseconds) the sixteen tabs associated with $CP_n$ are actuated, and the high current drivers are fired in sequence at 8.33 millisecond intervals until all 128 tabs have been actuated.

Referring now to FIG. 12, the terminals PS1 and $\overline{PS1}$ receive signals which serve to configure the clock oscillator in its operate mode. The clock provides signals for use throughout the system, these signals being $\overline{\phi}1$, $\overline{\phi}2$, $\overline{\phi}12$, $\sigma 1$, $\sigma 2$, $\overline{\beta}$, $\alpha$, and $\overline{\alpha}$ illustrated in FIG. 13 of the accompanying drawings. The clock produces a two phase output with subscripts 1 and 2 in the above signal identifications corresponding respectively with phase one and phase two. $\alpha$, $\overline{\alpha}$, and $\overline{\beta}$ are single phase signals.

In operation the system clock has two modes: idle mode and operate mode.

In the idle mode PS1 is a logic 0, $\overline{PS1}$ is a logic 1 and $V_{ss}$ is turned off. In this mode gates G1213, G1213, G1215, G1216, G1217 and G1218 and their associated circuitry are disabled due to the absence of the supply voltage $V_{ss}$. As a result $\sigma 1$, $\sigma 2$, $\alpha$ and $\overline{\beta}$ are not produced. The signals $\overline{\phi}1$, $\overline{\phi}2$ and $\overline{\phi}12$ are produced in the following manner. Gates G1201, G1212, G1203, and G1204 comprise the clock oscillator whose frequency is determined by by capacitor C10 and resistor R10. Transistors T1201 and T1202 are used to amplify the signal at the output of gate G1202 before feeding it to capacitor C10. In this manner a square wave having a frequency of approximately 8 KHz is produced at the output of gate G1204. This signal is fed through capacitor G1201, transistors T1205 and T1208 to gate G1205. The same signal is also fed through transistors T1206, T1207, and T1209 to gate G1206. In this manner the signal is transformed into a two-phase clock signal shaped in each phase as a narrow pulse due to the action of capacitors C1201 and C1202, amplified and fed to gates G1205 and G1206 which are connected as a set-reset flip-flop. This flip-flop again transforms the signal into a square wave with a two-phase output. One phase is fed from gate G1205, through resistor R1201 and capacitor C1203, whose action delays the signal a fixed amount, to gate G1207 where it is inverted and fed to gate G1209. At gate G1209 the delayed signal is combined with the signal directly from gate G1205 to produce a signal at the output of G1209, which is a narrow pulse of fixed width. In like manner, the signal from gate G1206 is fed through resistor R1202, capacitor C1204 and gates G1208 and G1209 to produce a second-phase signal which is a narrow pulse of fixed width.

The pulse from gate G1209 is fed through transistors T1210 and T1211 to transistor T1212 and through capacitor C1205 to transistor T1213. These last two transistors amplify the clock signal to produce $\overline{\phi}1$ having the characteristics of a narrow negative pulse whose most positive excursion is +5 volts and whose most negative excursion is −10 volts. Since the power supply voltages are only +5 volts and −5 volts, the −10 volts excursion is achieved through the voltage-doubling action of capacitor C1205.

In a like manner $\overline{\phi}2$ is produced through the action of transistors T1214, T1215, T1216 and T1217 and capacitor C1206.

$\overline{\phi}12$ is produced in the following manner: Signals $\overline{\phi}1$ and $\overline{\phi}2$ are fed through diodes D1201 and D1202, respectively, through C1207 and R1203 to transistor T1218 where they are amplified. In this mode of operation transistor T1219 is not conductive and contributes no affect.

In the operate mode the circuit thus described operates in a similar manner with the following exceptions: $\overline{PS1}$ is a logic 1 and PS1 is a logic 0, thus there exists a conductive path through transistors T10 and T11, the effect of which is to place R11 in parallel wth R10 changing the clock oscillator frequency to approximately 400 KHz. Transistors T1203 and T1204 serve to amplify the signal from gate G1203 before feeding it to R11. Thus $\overline{\phi}1$ and $\overline{\phi}2$ retain their shape as narrow negative pulses but at a much faster repetition rate. At the same time $V_{ss}$ is turned on causing transistors T1220 and T1219 to become conductive so that $\overline{\phi}12$ is clamped to $V_{bn}$ and assumes a value of −5 volts.

Furthermore $V_{ss}$ activates the remaining gates in the system clock producing $\rho 1$ $\rho 2$, $\alpha$, $\overline{\alpha}$ and $\overline{\beta}$ in the following manner:

$\overline{\phi}1$ is fed through resistor R1204 and capacitor C1208 to gate G1211. R1204 and C1208 serve to delay the $\overline{\phi}1$ signal a fixed amount. Gate G1211 inverts the signal and feeds it through C1210 to produce a negative pulse at the base of transistor T1221 which is delayed a fixed amount after the positive transition of $\overline{\phi}1$. T1221 amplifies this pulse and feeds it to gate G1213. In like manner $\overline{\phi}2$ is fed through R1205, C1209, C1211, and T1222 to gate G1214. Gates G1213 and G1214 are configured as a set-reset flip-flop and produce a two-phase output at $\rho 1$ and $\rho 2$ which is a square wave with a fixed phase relation to $\overline{\phi}1$ and $\overline{\phi}2$.

The $\rho 1$ signal is again transformed into a negative pulse by capacitor C1212 and fed through gate G1215 to gate G1216 to produce a negative pulse at $\overline{\beta}$ which is of fixed width and whose negative transition is in coincidence with the negative transition of $\rho 1$.

The signal at the output of G1215 is transformed into a negative pulse of fixed duration which is coincident with the positive transition of $\overline{\beta}$ through the action of C1213 and fed to gate G1217 where it is combined with $\overline{\beta}$ to produce a positive pulse of fixed duration which specifically is a fixed amount wider than $\overline{\beta}$ and whose positive transition is coincident with a negative transition $\rho 1$. This pulse appears at terminal $\alpha$. The $\alpha$ pulse is also inverted by the action of gate G1218 to produce $\overline{\alpha}$.

During periods in which all power to the system is turned off the clock is maintained in idle mode producing $\overline{\phi}1$, $\overline{\phi}2$ and $\overline{\phi}12$ through the action of batteries which supply the voltages $V_{bp}$ and $V_{bn}$.

FIG. 12 shows the relative relationship and timing of the signals produced during operate mode. However, $\overline{\phi 12}$, which is −5 volts during operate mode, is shown as a pulse train similar to the signal that appears during idle mode to show phase relation to $\overline{\phi 1}$ and $\overline{\phi 2}$.

Reference is now made to FIG. 14 and to the explanatory waveform diagram of FIG. 15. The $\overline{\alpha}$ signal is used to clock the seven flip-flops to provide outputs on the terminals Q. There are four of these Q terminals which are applied to the A, B, C and D inputs of the sixteen bit decoder included in 50. The output of the decoder consists of 16 signals identified as $\overline{D1}$ through $\overline{D16}$. The outputs of the flip-flops FF14 to FF16 are decoded to produce eight time slot groups X1 to X8, including sixteen time slots each. X1 to X8 signals are also produced in inverted forms $\overline{X1}$ to $\overline{X8}$. When logic zero pulses are received on the CLEAR 1 and CLEAR 2 terminals, the flip-flops are cleared, so that all Q outputs are logic zero. The system is in the X 1-D1 time slot. As successive negative transitions of $\overline{\alpha}$ are received, these being applied to the flip-flops FF10 and FF14, respectively, flip-flops count through a total of 128 states. The states of the first four flip-flops are decoded into sixteen parallel bits which are in time sequence, producing $\overline{D1}$ through $\overline{D16}$ by a decoder. This 16-bit decoder is a type 74154 TTL integrated circuit. The decoder is strobed by $\alpha$ so that no output is a logic zero when $\alpha$ is a logic 1. This produces a guard band between the time slots approximately .33 microseconds long. When $\overline{D16}$ is a logic 0, its signal, inverted by gate G1401 is fed to FF14 to enable it to be clocked by $\overline{\alpha}$. Line 17, after "flip-flops" insert — FF14, FF15 and FF16. Line 19, before "The" insert — The Q output of FF15 and FF16 are fed to gate G1402 at whose output appears a logic 1 only when QFF15 and QFF16 are both logic 0. This signal is then fed to gate G1403 and combined with $\overline{QFF14}$ to provide at the output of G1403 a logic 0 only when QFF14, QFF15 and QFF16 are all logic 0. $\overline{X1}$ is inverted by gate G1404 to produce X1. Successive clockings of the flip-flop occur, and the last three flip-flops count to eight. This information is decoded by the combinational logic illustrated, creating the time slot groups X1 through X8 and $\overline{X1}$ through $\overline{X8}$. The timing of the $\overline{D1}$ to $\overline{D16}$ pulses with respect to the $\overline{\alpha}$ pulses is illustrated in FIG. 15, and operating through the entire sequence $\overline{D1}$ to $\overline{D16}$ requires 40 microseconds. The $\overline{X1}$ and $\overline{X8}$ pulses are illustrated in FIG. 15. These pulses require 320 microseconds to complete the sequence. For the $\overline{X1}$ pulse 16 $\overline{D}$ pulses occur; for the $\overline{X2}$ pulse, 16 further $\overline{D}$ pulses occur, and so on until 128 pulses have been generated.

Referring to FIG. 16, terminal $\overline{\alpha}$ receives a clock signal which is used to clock flip-flops FF20 to FF24. $\rho 1$ and $\rho 2$ are input gating signals which reference time slot allocation to the appropriate clock phase. $\overline{DRS1}$ and XRS1 are each one of $\overline{D1}$ through $\overline{D16}$ and X1 through X8 respectively which are selected to program the time slot corresponding to reversible stop number one. $\overline{DRS2}$ through $\overline{DRS5}$ and XRS2 through XRS5 are selected in a similar manner for reversible stop numbers 2 through 5. $\overline{LR1}$ through $\overline{LR5}$ derive from the piston latches 30 to determine which reversible stop is to be enabled. $\overline{LG1}$ and $\overline{LG2}$ derive from the latches 30 to determine which set of general combinations is to be enabled. $\overline{LG1}$ corresponding to clock phase 1 and $\overline{LG2}$ corresponding to clock phase 2 in the memory. $\overline{LD1}$ through $\overline{LD5}$ derive from the latches 30 to determine which division of stops is to be enabled. $\overline{DED1}$ and $\overline{XED1}$ are each one of $\overline{D1}$ through $\overline{D16}$ and $\overline{X1}$ through $\overline{X8}$, respectively, which are selected to program the last time slot included in Division 1. $\overline{DED2}$ through $\overline{DED5}$ and $\overline{XED2}$ through $\overline{XED5}$ are selected in a similar manner for Divisions 2 through 5. These signals also identify the time slot prior to the first time slot in the next division. For example, the inputs $\overline{X8}$ and $\overline{D16}$ identify X1–D1 as the first time slot in Division 1 and X8–D16 as the last time slot for Generals Only stops. The output at the terminal $\overline{TSW}$ provides a signal to the memory program control logic 28 in reference to the clock phase and used to control which memory positions in respect to time slots are to be programmed or readout, there being 128 such positions for each clock phase. If $\overline{LR1}$ is a logic zero when $\overline{DRS1}$ is a logic 0 and XRS1 is a logic 1, $\overline{TSW}$ is a logic zero. $\overline{TSW}$ is a logic zero only during one out of 128 counts produced in the counter and decoder 50. When $\overline{LG1}$ is a logic zero, $\overline{TSW}$ is a logic zero provided $\rho 1$ is a logic 1. Thus $\overline{TSW}$ is a logic zero during all of the 128 counts produced in the counter and decoder 50 during clock phase one, but $\overline{TSW}$ is a logic 1 during clock phase two. Operation is similar when $\overline{LG2}$ is a logic zero, in which case $\overline{TSW}$ is a logic zero during clock phase 2 and a logic 1 during clock phase 1. When $\overline{LD1}$ is a logic zero and when $\overline{X8}$ and $\overline{D16}$ are received together, the next negative transition of $\overline{\alpha}$ causes $\overline{Q}$ of FF20 to become a logic 0. $\overline{TSW}$ then becomes a logic 0 during each succeeding clock phase 1. when $\overline{XED1}$ and $\overline{DED1}$ are received the next negative transition of $\overline{\alpha}$ causes $\overline{Q}$ of FF20 to become a logic 1. $\overline{TSW}$ is then no longer driven to logic 0; thus $\overline{TSW}$ is negative during clock phase 1 for a specific number of adjacent counts produced in the counter and decoder 50. Operation is similar when $\overline{LD2}$ through $\overline{LD5}$ are received. Divisions 1 through 5 of the organ are non-overlapping, but they are adjacent in that the end of one division and the beginning of the next occur in adjacent counts. The five divisions do not necessarily include all 128 counts. Unused counts appear at the end of division 5. These unused time slots may be stops operated by general pistons only, but cannot be operated by division pistons. The gates terminating at $\overline{TSW}$ are open-collector devices connected in a wired-OR configuration.

FIG. 17 illustrates the piston matrix and the associated latches. When a control piston is depressed, current flows through terminals $\overline{SS}$ generating a negative pulse to the mode sequence control 10. VL is a voltage deriving from the mode sequence control 10 enabling the latches to hold control piston information during an operational sequence. There are in all twelve time slot control latches, and fourteen memory control latches. The piston, when actuated, connects one horizontal line to one vertical line in the piston matrix, thus actuating one time slot control latch and one memory control latch. FIG. 17 does not illustrate all the outputs which can be produced by the latches, but represents one typical time slot control latch and one typical memory control latch. The actual signals produced by the twelve latches are as follows: $\overline{LR1}$ through $\overline{LR5}$ are produced by the time slot control latches for the reversible stops 1 through 5; $\overline{LG1}$ is produced by the time slot control latch for phase one general combinations; $\overline{LG2}$ is produced by the time slot control latch for phase two general combinations; LD1 through LD5 are produced by the time slot control latches for the divisions 1 through 5. The memory control latches, of which one typical latch is shown in FIG. 17, signals to the memory to determine which set of information is to be programmed or readout. Signals which can be produced by the fourteen latches are the following: $\overline{SRC1}$ through $\overline{SRC12}$, which control shift register channels 1 through 12; $\overline{SRD}$ which controls shift register defeat and $\overline{RNC}$ which controls the reversible memory channel. The $\overline{MLE}$ terminal signals to the mode sequence control 10 to inhibit the enable mode when a memory channel is not latched on. When a control piston is depressed current flows in the base of the NPN transistor T21, collector potential then falls gating a negative pulse at $\overline{SS}$. This produces a logic zero at the time slot control output and the PNP transistor T20 is turned on which latches in T21. This circuit configuration is maintained so long as VL is maintained, during an operational sequence. When a control piston is depressed the base of T21 is connected to the base of T23, turning the latter on and gating a negative pulse at $\overline{SS}$. Collector current in T23 turns T24 on which in turn latches in T23 and provides a logic zero at the memory control output. This circuit configuration is maintained so long as VL is maintained during an operational sequence. Current in T23 turns on T25 which in turn causes T22 to conduct producing a logic zero at $\overline{MLE}$ which is sent to the mode sequence control 10 signalling that a memory control latch is energized.

Referring now to FIG. 18, when $\overline{SET}$ is a logic zero and SET is logic one, the memory is configured to accept input data and readout is inhibited. When $\overline{SET}$ is a logic 1 and SET is a logic 0, the memory is configured to read out data and programming is inhibited.

Gates G1801 and G1802 are configured as a set-reset flip-flop. If the set piston is not depressed the switch contacts are open. When $V_{ss}$ is applied at the start of the operational sequence the input labeled A to G1802 will rise toward the supply voltage faster than the input labeled B to gate G1801. This is caused by the slowing effect of capacitor C21. In this manner the flip-flop will be configured with SET a logic 0 and $\overline{SET}$ a logic 1 and this condition maintained until the end of the operational sequence unless the set piston is depressed.

If the set piston is depressed at any time that $V_{ss}$ is applied the input labeled A to G1802 will become a logic 0 causing the flip-flop to change states so that SET is a logic 1 and $\overline{SET}$ is a logic 0. This configuration, once established cannot be changed until $V_{ss}$is removed at the end of the operational sequence.

In FIG. 19, Y1′ and Y8′, which represent buffered AC line counts 1 through 8, are multiplexing drives for the tab switches TS1 to TS8. $\overline{XY}$ represents a signal received from the coincidence gates 80 which is used to synchronize the data multiplexer. When $Y_n'$ is logic 1, a positive voltage is applied to one switch out of every eight. If that tab switch is closed, this positive voltage is coupled through an isolation diode and the appropriate input buffer to provide a logic 0 at the corresponding input of the multiplexer which is a type 74150 TTL integrated circuit. The Q signals represent in binary form each of the sixteen time slots produced in the counter and decoder 50, used to select which input line to the multiplexer is coupled to the output terminal DF. A closed switch will appear as a logic 1 on DF. $\overline{XY}$ is used to enable DF to become a logic 0 only when $\overline{XY}$ is a logic zero. Therefore, the information on DF is encoded with respect to D, representing time slots, X representing time slot groups, and Y representing AC line count. The $Y_n'$ drive to the tab switches provides an input voltage that is at all times 0 volts or positive, therefore being compatible with the organ gate.

In FIG. 20 the terminal DF receives signal from the tab switch multiplexer 84 of FIG. 19, containing encoded switch position data. Terminals $\overline{SET}$ receive a signal from the program/readout control 20 to permit programming of data and to disable readout of data from the memory. The terminal $\overline{XY}$ receives a synchronization signal from the coincidence gates 80. Terminal $\overline{TSW}$ receives a control signal from the programmable time slot decoder and piston gate 64. Terminal $\overline{DE}$ receives a signal from the mode sequence control 10 serving to configure the memory in its enable mode. The terminal SET receives signal from the program/readout control 20 to permit insertion of synchronization pulse into memory. The terminal $\sigma 2$ receives a signal from the system clock 14 which enables the synchronization pulse to be stored in the memory cell corresponding to clock phase 2. Terminals $\overline{X1}$ and $\overline{D1}$ receive signals from the counter and decoder 50 50 to be programmed into memory as the synchronization pulse. The junction ID is connected directly to the input of the memory channels, exemplary ones of which are shown as No. 1 and No. 2 in the Figure, and at this point appears switch position data for input into the shift register. The junction OD contains signals at the output of the shift registers containing switch position data. The terminals $\overline{\phi 1}$ and $\overline{\phi 2}$ receive signals from the system clock 14 which are used to clock the shift registers. The terminal $\overline{\phi 12}$ receives a signal from the system clock 14 which is used to bias the output of the shift register, this signal being clamped to $V_{bn}$ during an operational sequence of read-in and read-out. $\overline{CSE}$ receives a signal from the mode sequence control 10 which is used to configure the system in the sync mode. $\overline{SRC1}$ and $\overline{SRC2}$, representing twelve shift register controls, receive inputs from the latches to determine which channel of information is to be programmed or read out. $\alpha$, $\overline{\alpha}$, and $\overline{\beta}$ are terminals for receiving signals from the system clock 14 used to provide clocking and desired guard bands in the memory readout control 24. CE line carries a signal used to control the data output to the low current drivers. SRD terminal receives a signal from the latches 30 to force the data readout to all zeroes in order to implement the cancel function. $\overline{RMC}$ receives a signal from the latches 30 to enable the temporary memory, in order to implement the reversible stop function. DD and $\overline{DD}$ provide output signals containing switch position data delayed a full clock period, to be used as output information to drive the low current drivers. ONC is an output signal supplied to the low current drivers and used to drive on coils of the tabs while OFC is a corresponding encoded signal to the low current drivers which is used to drive the off coils of the tabs. Clear 1 and clear 2 terminals provide pulses to the counter and decoder 50 used to synchronize it with the memory.

Except during a start up sequence and an operational sequence, shift registers operate in a recirculate mode. During this mode power is supplied only to the shift registers and to the clock. The clock frequency is reduced to 8 KHz and the registers are clocked by $\overline{\phi 1}$ and $\overline{\phi 2}$ at this rate to provide low power consumption in the shift register. $\overline{\phi 1 \overline{2}}$ is negative only when $\overline{\phi 1}$ or $\overline{\phi 2}$ is negative. Thus, the current drain on the battery supply which is used during standby and recirculate mode is minimized. Data appearing at the shift register No. 1 output is fed through the 390 ohm resistor R30 to the input, forcing the data to continuously recirculate through the shift register during the idle mode.

The sync mode of operation occurs only at the beginning of an operational sequence and is of approximately 1 millisecond duration. During this mode the memory program control 28 and memory readout control 24 are disabled so that data in the shift register is continuously recirculating. When $\bar{\phi}2$ clocks the synchronization pulse to the output of shift register No. 1, the negative transition of $\rho 2$ causes a negative pulse to be fed through gates G2001 and G2002 and to appear at clear 1 and clear 2 terminals. This is used to set the counter and decoder 50 to count one out of 128 positions. The temporary memory is reset and held in the reset position during this period by a signal applied to $\overline{CSE}$ which is then a logic 0.

In the enable mode of operation when data is being programmed, the $\overline{CSE}$ signal becomes a logic 1 and $\overline{DE}$ becomes a logic 0. This disables any output at clear 1 and clear 2, and enables the memory program control logic 28 and memory readout control logic 24. If SET is a logic 1 and $\overline{SET}$ is a logic 0, the memory program control logic 28 will program data into the shift register in the following manner: When $\overline{TSW}$ and $\overline{XY}$ are both logic zero, the logic level of DF will be fed through gates G2003 and G2004 and will appear at the input to any shift register that has been selected by logic zero at $\overline{SRC}$. The next negative pulse of $\bar{\phi}1$ or $\bar{\phi}2$ will store this information in the shift register. The information will appear at the output of the shift register 128 clock periods later in phase with a negative pulse of the same clock phase that stored it. 128 bits of information can be stored sequentially on each clock phase. This creates two memory cells in each shift register.

During programming when $\rho 2$ is a logic 1 and $\overline{DI}$ and $\overline{XI}$ are both logic 0, a logic 1 is fed through gates G2007 and G2008 and appears at the input of shift register No. 1 and is stored in phase with $\bar{\phi}2$. Thus the 128 bits associated with $\bar{\phi}2$ in shift register No. 1 form the memory cell used to synchronize the counter and decoder 50 with the memory. The twelve shift registers provide 24 memory cells, of which one is the sync channel, leaving 23 cells in which to store information. Each shift register has an NPN transistor connected at its output, i.e., T31 and an open-collector nand gate connected to its input, in order to present a high impedance during recirculation and readout. An open collector gate cannot force a logic 1. Therefore, the transistor T31 is used to provide a logic 1 at the input through the 390, ohm feedback resistor.

In the enable mode of operation, when reading out data, SET is a logic 0 and $\overline{SET}$ is a logic 1, the NOR gates at the shift register inputs provide a logic zero at their outputs, holding the NPN transistor T31 off. Thus the input NAND gates cannot provide a logic zero and T31 cannot provide a logic 1, thereby allowing the shift register to recirculate while data is being readout. The memory readout control 24 will transfer data from the shift registers or the temporary memory in the following manner: Data from a shift register that is selected by a logic zero at SRC is fed through T30 and gates G2005 and G2006 and appears at the input to flip-flop FF30. This data contains both cells of information in the shift register. The flip-flop is clocked by a signal derived from $\overline{TSW}$ which is referenced to clock phase. Thus the two cells are separated and the output of the flip-flop FF30 contains only that information stored in the correct cell. The next positive transition of $\bar{\beta}$ clocks data to FF35 and then holds it for one full clock period, thus restoring the duration of each piece of data to one full clock period but delayed one full clock period.

The signal derived from $\overline{TSW}$ is also fed through flip-flops FF31 and FF32, combined with XY in G2009, fed through a NOR gate G2010 to line CE. In this operation a signal is generated which encompasses the time slots enabled by $\overline{TSW}$ and contains a guard band the width of $\alpha$ between consecutive time slots. Furthermore, the signal occurs only during the correct $Y_n$ time period. This information is delayed one full clock period in order to be in sync with DD and $\overline{DD}$. ONC and OFC then have output pulses by AND gating DD, $\overline{DD}$ and CE. These are serially encoded and must be decoded by the low current drivers as previously described and substitute therefor, — are then derived by combining DD and CE in gate 2011 and feeding its output to transistor T2001 to produce ONC. Likewise, $\overline{DD}$ and CE are combined in gate G2012 and fed to T2002 to produce OFC. These two signals ONC and OFC are therefore pulse trains containing serially encoded data used to drive the low current drivers as previously described. When $\overline{SRD}$ is a logic 0, DD is forced to readout. This implements the cancel feature. When $\overline{SET}$ is a logic 0, CE is forced to remain a logic 0, thus inhibiting generation of ONC and OFC. Therefore, readout is inhibited while programming data into the memory.

The temporary memory operates as follows during an enable mode. When $\overline{XY}$ and $\overline{TSW}$ both become a logic 0 for the first time in a sequence of operations, the logic level of DE is fed through G2013 and G2014 and is stored in flip-flop FF33. The next positive transition of $\overline{TSW}$ is fed through G2015 and clocks flip-flop FF34 to produce a logic 1 at its Q output, thus inhibiting further read-in of information from DF. The logic level stored in flip-flop FF33 is held throughout the remainder of the operating sequence. When $\overline{RMC}$ is a logic 0, this stored information is fed through G2016 and G2017 and processed by the memory readout control as previously described, thus implementing the reversible stop function.

Referring to FIG. 23, when organ power is turned off the voltages $V_{bp}$ and $V_{bn}$ remain available, because these are derived from batteries B1 and B2 which are on trickle charge normally from rectified AC line. As long as the line voltage is present in the organ, whether or not the power switch is off, the batteries are continually being charged, and are continually available. When the organ power is switches on, the unregulated voltages, i.e., −8.5 volts, −16 volts, RB, +16 volts and +15 volts become available, as does HV1 and HV2 which are used to supply power to the drive coils and in this respect represent a two phase line. If any flip-flop in the mode sequence control 10 is in an incorrect state when $V_{rr}$ turns on, PS1 or PS2 will be a logic 1 turning on $V_{ss}$. After the mode sequence control cycles to the correct state, PS1 and PS2 become logic zero and $V_{ss}$ shuts down.

The power supply voltages are generated in the following manner.

When the AC line is applied to XR2301 the unregulated voltages previously mentioned are present. The +15 volts is regulated by zener diode D2301 and fed through a resistor divider to the non-inverting input to amplifier A2301. A2301 and T2301 serve as the power supply regulator providing a regulated output voltage at $V_{rr}$. Feedback from the terminal $V_{rr}$ to the inverting input of A2301 provides stability.

$V_{rr}$ is applied to the non-inverting input terminal of A2302 as a reference. When either PS1 or PS2 is a logic 1, current through resistor R2301 to the base of T2305 turns T2305 on discharging capacitor C51 rapidly. This action causes diode D2302 to become reverse biased and the $V_{ss}$ power supply regulator consisting of A2302, T2302 operates in a manner similar to the $V_{rr}$ supply regulator previously discussed. When PS1 and PS2 both become a logic 0 T2305 turns off allowing C51 to charge through R2302. When the charge on C51 becomes sufficient to forward bias D2302 a voltage more positive than $V_{rr}$ is applied to the inverting input of A2302. The action of A2302 then causes the $V_{ss}$ supply to be driven negative turning that supply off.

When PS1 becomes a logic 1 D2303 becomes reverse biased allowing C50 to charge toward $V_{ss}$ through R2303. When the charge on C50 becomes greater than the voltage applied by $V_{rr}$ through D2304 to the inverting input of A2303, D2304 becomes a reverse biased and the $V_{dd}$ supply regulator consisting of A2303 and T2303 operates in a manner similar to the $V_{rr}$ supply regulator previously discussed using as a reference voltage $V_{ss}$ supplied through R2303 to the non-inverting input of A2303.

When PS1 becomes a logic 0 C50 discharges through R2304, D2303 and terminal PS1. When the charge on C50 decreases sufficient to allow D2304 to become forward biased the output of A2303 will be driven negative turning the $V_{dd}$ supply off.

The actions of T2305, C51, R2303, C50 and R2303 cause the $V_{dd}$ supply to turn on a short time after the $V_{ss}$ supply is turned on and also cause the $V_{dd}$ supply to turn off a short time before the $V_{ss}$ supply is turned off. The purpose for this time relationship is to protect the memory from power supply transients which might alter the stored data.

What we claim is:

1. A combination stop system for an electronic organ, comprising an electronic memory, a set of tabs for setting stops, read in means for reading the settings of said tabs into said memory, read out means for setting said tabs in response to information stored in said memory, clock means operative for recirculating within said memory information stored in said memory at a predetermined rate, a rectifier system power supply for energizing said electronic memory and said clock means, a battery supply for said combination stop system, means energizing said memory and said clock means from said battery supply only in response to said power supply being off, means including a set of pistons for selectively operating said read in means and said read out means, and means responsive to operation of any one of said pistons for turning on said rectifier system power supply.

2. The combination according to claim 1, wherein said read in means includes means for time division multiplexing information of the actuated and unactuated states of said tabs of all said divisions in only a single time scan.

3. The combination according to claim 2, wherein said read in means includes means for reading into said memory information pertaining to the states of said tabs in only a single time division multiplex scan in response to actuation of one of said pistons.

4. In an electronic multi-division organ having stop tabs, a combination stop system, said system including plural multi-location electronic memories, means allocating stop tab information for separate division of said organ to different memory locations of selective ones of said memories, a set of pistons, and means responsive to actuation of any one of said pistons for time division scanning all said memory locations of one of said memories allocated to the actuated one piston of said set of pistons in a single scan.

5. In an electronic organ including a stop combination action system for selectively actuating predetermined combinations of stop tabs and an electronic memory for storing data representative of preselected positions of stop tabs; an improved mans for positioning the stop tabs comprising:

a plurality of coil means, each of said coil means for controlling the position of a respective stop tab when conducting AC current, said coil means being grouped into plural groups of coil means;

a plurality of switching means, said switching means including a source of AC current, each switching means being respectively connected to a corresponding group of coil means, said plurality of switching means for sequentially supplying AC electrical current to the corresponding groups of coil means;

a plurality of actuating means, each actuating means being connected to a corresponding coil means within each group of coil means, said actuating means for allowing its respective coil means to conduct AC current so that said coil means will position its respective stop tab in a predetermined position in response to receipt of input data signals from the memory representative of the selected position of the corresponding stop tab.

6. An improved means, as claimed in claim 5, wherein said source of AC current produces two-phase AC current having a first phase and a second phase, and said plurality of switching means alternatively supplies to successive groups of coil means in a time sequential manner first phase AC current and second phase AC current.

7. An improved means, as claimed in claim 6, wherein the total number of stop tabs equals an integer N, and the total number of groups of coil means equals N/A where A is an integer divisible into N equal to the number of coil means in each group of coil means.

8. An improved means, as claimed in claim 6, wherein said plurality of switching means successively supplies AC electrical current to successive groups of coil means for a duration of one-half cycle for each successive groups of coil means so that electrical current is supplied to the total number of groups of coil means by a number of half cycles of AC current equal to the number of groups of coil means.

9. An improved means, as claimed in claim 5, wherein said actuating means is responsive only to data signals relating to the group of coil means to which AC electrical current is then sequentially being supplied.

10. An improved means, as claimed in claim 7, wherein the instantaneous AC electrical current drain on said source of AC current is a function of A/N of the total current drain required to operate all of the coil means.

* * * * *